US011055951B2

(12) United States Patent
La Guardia et al.

(10) Patent No.: US 11,055,951 B2
(45) Date of Patent: Jul. 6, 2021

(54) INDIVIDUAL METAMORPHIC LINKED JACKPOTS

(71) Applicant: Aristocrat Technologies Australia Pty Limited, North Ryde (AU)

(72) Inventors: Chad La Guardia, Austin, TX (US); Hanna Lee Sanborn, Pflugerville, TX (US); Erick T. Ching, Cedar Park, TX (US); Arlen Avakian, Plano, TX (US); Brittany Nyberg Nelson, Liberty Hill, TX (US); Lane Alan Shapiro, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 27 days.

(21) Appl. No.: 16/290,833

(22) Filed: Mar. 1, 2019

(65) Prior Publication Data

US 2020/0279451 A1 Sep. 3, 2020

(51) Int. Cl.
*G07F 17/32* (2006.01)

(52) U.S. Cl.
CPC ..... *G07F 17/3213* (2013.01); *G07F 17/323* (2013.01); *G07F 17/3209* (2013.01); *G07F 17/3244* (2013.01); *G07F 17/3267* (2013.01); *G07F 17/3239* (2013.01)

(58) Field of Classification Search
CPC ..... G07F 17/3267; G07F 17/3244; G07F 17/3209; G07F 17/3213; G07F 17/323
See application file for complete search history.

(56) References Cited

U.S. PATENT DOCUMENTS

| | | | |
|---|---|---|---|
| D259,499 | S | 6/1981 | Dunham |
| 5,342,518 | A | 8/1994 | Posner |
| 5,755,621 | A | 5/1998 | Marks |
| 5,767,854 | A | 6/1998 | Anwar |
| 5,779,242 | A | 7/1998 | Kaufmann |
| 5,779,549 | A | 7/1998 | Walker |
| 6,039,648 | A | 3/2000 | Guinn |

(Continued)

FOREIGN PATENT DOCUMENTS

| | | | |
|---|---|---|---|
| AU | 630112 | B | 3/1993 |
| AU | 1997022551 | A1 | 8/1997 |

(Continued)

OTHER PUBLICATIONS

Notice of Allowance dated Jun. 17, 2020 for U.S. Appl. No. 29/682,178 (pp. 1-10).

(Continued)

*Primary Examiner* — Steve Rowland
(74) *Attorney, Agent, or Firm* — Weaver Austin Villeneuve & Sampson LLP

(57) ABSTRACT

A local electronic gaming device may include a display system, an interface system and a control system that includes one or more processors. The control system may cause the display system to present visual effects corresponding to a metamorphic image, which may correspond to an award. The visual effects may include changes to the metamorphic image in response to local game event data corresponding to one or more games presented on the local gaming device and in response to networked gaming device game event data corresponding to one or more games presented on one or more other gaming devices.

20 Claims, 20 Drawing Sheets

(56) References Cited

U.S. PATENT DOCUMENTS 6,082,887 A 7/2000 Feuer
6,093,100 A 7/2000 Singer
6,224,486 B1 5/2001 Walker
6,287,202 B1 9/2001 Pascal
6,293,865 B1 9/2001 Kelly
6,309,299 B1 10/2001 Weiss
6,354,592 B1 3/2002 Virzi
6,425,828 B2 7/2002 Walker
6,620,045 B2 9/2003 Berman
D492,692 S 7/2004 Fallon
6,817,948 B2 11/2004 Pascal
D499,786 S 12/2004 Dropo
6,908,390 B2 6/2005 Nguyen
7,354,345 B2 4/2008 Bortnik
7,516,959 B2 4/2009 Huard
D605,725 S 12/2009 Chang
7,682,251 B2 3/2010 Bortnik
7,684,874 B2 3/2010 Schlottmann
7,684,882 B2 3/2010 Baerlocher
7,689,302 B2 3/2010 Schlottmann
7,690,996 B2 4/2010 Iddings
7,704,144 B2 4/2010 Abbott
7,753,790 B2 7/2010 Nguyen
7,780,520 B2 * 8/2010 Baerlocher ..... G07F 17/3225 463/25
7,787,972 B2 8/2010 Schlottmann
7,798,901 B2 9/2010 Nguyen
7,824,267 B2 11/2010 Cannon
7,878,899 B2 2/2011 Duhamel
7,972,209 B2 7/2011 Kelly
7,976,389 B2 7/2011 Cannon
8,002,630 B2 8/2011 Nguyen
8,043,157 B2 10/2011 Cannon
8,070,583 B2 12/2011 Baerlocher
8,092,309 B2 1/2012 Bickley
8,142,272 B2 3/2012 Walker
8,157,647 B2 4/2012 House
8,192,270 B2 6/2012 Slomiany
8,202,165 B2 6/2012 Duhamel
8,246,434 B2 8/2012 Moody
8,246,439 B2 8/2012 Kelly
8,277,298 B2 10/2012 Mace
8,317,620 B2 11/2012 Kelly
8,342,957 B2 1/2013 Carpenter
8,419,520 B2 4/2013 Johnson
8,419,546 B2 4/2013 Decasa
8,430,736 B2 4/2013 Cannon
8,439,733 B2 5/2013 Kay
8,449,386 B2 5/2013 Englman
8,469,788 B2 6/2013 Carpenter
8,485,892 B2 7/2013 Nguyen
8,506,394 B2 8/2013 Kelly
8,512,119 B2 8/2013 Kelly
8,523,682 B2 9/2013 Bickley
8,540,577 B2 9/2013 Shvili
8,562,418 B2 10/2013 Gomez
8,585,481 B2 11/2013 Owen
8,585,494 B2 * 11/2013 Parrinello ..... G07F 17/3283 463/27
8,591,338 B2 11/2013 Nguyen
D694,773 S 12/2013 Sakaguchi
D695,778 S 12/2013 Edwards
8,602,877 B2 12/2013 Carpenter
8,613,650 B2 12/2013 Kovacs
8,622,793 B2 1/2014 Ford
8,622,817 B2 1/2014 Englman
8,641,507 B2 2/2014 Kelly
8,641,515 B2 2/2014 Nicely
8,684,830 B1 4/2014 Chun
8,690,661 B2 4/2014 Cannon
8,702,499 B2 4/2014 Johnson
8,702,520 B2 4/2014 Seelig
8,715,051 B2 5/2014 Davis
8,715,052 B2 5/2014 Bennett
8,715,069 B2 5/2014 Arnone
8,721,421 B2 5/2014 Tempest
8,734,232 B2 5/2014 Bunch
D706,808 S 6/2014 Edwards
D710,372 S 8/2014 Dellinger
8,801,518 B2 8/2014 Lipscomb
8,808,077 B1 8/2014 Chun
8,840,462 B2 9/2014 Patel
8,851,980 B2 10/2014 Versaci
8,851,981 B2 10/2014 Ramsey
8,852,001 B2 10/2014 Kelly
8,870,659 B2 10/2014 House
8,894,480 B2 11/2014 Johnson
8,905,841 B2 12/2014 Carpenter
9,005,010 B2 4/2015 Watkins
9,011,241 B2 4/2015 Kelly
D730,373 S 5/2015 Clement
9,022,867 B2 5/2015 Kelly
9,033,786 B2 5/2015 Kelly
D732,054 S 6/2015 Yoneda
9,070,255 B2 6/2015 Christensen
9,111,416 B2 8/2015 Cannon
9,123,208 B2 9/2015 Davis
9,123,210 B2 9/2015 Bennett
D741,897 S 10/2015 Wilkinson
9,155,968 B2 10/2015 Hedrick
9,159,198 B2 10/2015 Moshal
9,165,429 B2 10/2015 Cannon
9,165,430 B2 10/2015 Bickley
9,171,426 B2 10/2015 Dimichele
9,177,445 B2 11/2015 Vemuri
9,214,056 B2 12/2015 Kovacs
D750,113 S 2/2016 Kettner
D753,158 S 4/2016 Mezzanotte
9,311,773 B2 4/2016 Chun
D759,065 S 6/2016 Mezzanotte
9,361,754 B2 6/2016 Decasa, Jr.
9,364,753 B2 6/2016 Bennett
9,384,631 B2 7/2016 Arnone
9,384,635 B2 7/2016 Nguyen
9,401,073 B2 7/2016 Lee
D763,904 S 8/2016 Knapp
9,430,908 B2 8/2016 Owen
9,443,393 B2 9/2016 Johnson
9,443,394 B2 9/2016 Carpenter
D771,670 S 11/2016 Chan
D772,252 S 11/2016 Chaudhri
D772,260 S 11/2016 Ingenlath
D772,894 S 11/2016 Zhao
9,495,838 B2 11/2016 Davis
9,520,020 B2 12/2016 Bickley
9,530,280 B2 12/2016 Melnick
9,558,632 B2 1/2017 Melnick
D780,201 S 2/2017 Zielinski
9,569,933 B2 2/2017 Baker
9,607,479 B2 3/2017 Robbins
D783,655 S 4/2017 Hu
9,613,492 B2 4/2017 Englman
9,616,331 B1 4/2017 Jordan
9,626,836 B2 4/2017 Arnone
9,633,509 B2 4/2017 Cannon
D788,167 S 5/2017 Fox Uribe
9,656,174 B1 5/2017 McLellan
9,697,671 B2 7/2017 Moody
9,697,674 B2 7/2017 Morrissette
9,715,790 B2 7/2017 Arnone
9,734,660 B2 8/2017 Kiely
9,747,754 B2 8/2017 Carpenter
D801,990 S 11/2017 Reissner
D804,505 S 12/2017 Hoffman
9,858,750 B2 1/2018 Kovacs
9,984,529 B2 5/2018 Kim
9,990,806 B2 6/2018 Davis
D823,336 S 7/2018 Tinney
10,013,852 B1 7/2018 Jordan
10,032,338 B2 7/2018 Lark
10,055,940 B2 8/2018 Arnone
10,109,155 B2 10/2018 Chase
D834,604 S 11/2018 Feldman
D836,653 S 12/2018 Zhou

(56) References Cited

U.S. PATENT DOCUMENTS 10,195,532 B1 2/2019 McLellan
D842,316 S 3/2019 Toth
10,235,841 B2 3/2019 Nguyen
10,255,765 B2 4/2019 Washington
D847,833 S 5/2019 Toth
D849,771 S 5/2019 Foley
D852,830 S 7/2019 Penacho
D854,554 S 7/2019 Toth
10,354,491 B2 7/2019 Melnick
10,360,766 B2 7/2019 Arnone
10,373,442 B2 8/2019 Schlottmann
10,395,474 B2 8/2019 Englman
D858,535 S 9/2019 Evans
10,424,162 B2 9/2019 Heenan
D861,703 S 10/2019 Suslik
D861,710 S 10/2019 Frackelton
10,445,985 B2 10/2019 Davis
10,460,568 B2 10/2019 Givant
D867,391 S 11/2019 Yoshioka
D868,825 S 12/2019 Paulik
D870,123 S 12/2019 Butcher
D870,126 S 12/2019 Crispino
10,504,332 B2 12/2019 Riggs
10,510,215 B2 12/2019 Arnone
10,515,514 B1 12/2019 Weaver
10,540,852 B2 1/2020 Lark
D875,110 S 2/2020 Spors
D876,450 S 2/2020 Suslik
D876,477 S 2/2020 Gansert
D879,122 S 3/2020 Ebler
10,621,829 B2 4/2020 Loader
D889,493 S 7/2020 Schwegler
D890,790 S 7/2020 Marks
D895,645 S 9/2020 Sanborn
D896,256 S 9/2020 Kawaichi
D898,769 S 10/2020 Park
D905,106 S 12/2020 Kang
D905,736 S 12/2020 Felkins
2002/0028707 A1 3/2002 Pascal
2002/0119824 A1 8/2002 Allen
2003/0060264 A1 3/2003 Chilton
2004/0229700 A1 11/2004 Cannon
2005/0020352 A1 1/2005 Chilton
2005/0071024 A1 3/2005 Henshaw
2006/0058082 A1 3/2006 Crawford, III
2006/0082056 A1 4/2006 Kane
2006/0148565 A1 7/2006 Gauselmann
2006/0157934 A1 7/2006 Yoseloff
2006/0178202 A1 8/2006 Hughes
2006/0287045 A1 12/2006 Walker
2007/0129147 A1 6/2007 Gagner
2007/0191102 A1 8/2007 Coliz
2007/0218968 A1 9/2007 Snow
2007/0243936 A1 10/2007 Binenstock
2008/0045288 A1* 2/2008 Moshal ..... G07F 17/32 463/16
2008/0070692 A1 3/2008 Schlottmann
2008/0070693 A1 3/2008 Schlottmann
2008/0070694 A1 3/2008 Schlottmann
2008/0070695 A1 3/2008 Baerlocher
2008/0207313 A1* 8/2008 Acres ..... G07F 17/3258 463/27
2008/0254883 A1 10/2008 Patel
2009/0005150 A1 1/2009 Haveson
2009/0011810 A1 1/2009 Moshal
2009/0011827 A1 1/2009 Englman
2009/0029773 A1 1/2009 Cherry
2009/0061999 A1 3/2009 Popovich
2009/0069093 A1 3/2009 Kelly
2009/0118000 A1 5/2009 Yoshizawa
2009/0170584 A1 7/2009 Tan
2009/0197659 A1 8/2009 Christensen
2009/0270168 A1* 10/2009 Englman ..... G07F 17/32 463/27
2009/0275374 A1 11/2009 Nelson
2010/0022307 A1 1/2010 Steuer
2010/0035674 A1 2/2010 Slomiany et al.
2010/0062840 A1 3/2010 Herrmann
2010/0070056 A1 3/2010 Coronel
2010/0105470 A1* 4/2010 Englman ..... G07F 17/3227 463/27
2010/0210356 A1 8/2010 Losica
2010/0210362 A1 8/2010 Toompere
2010/0227686 A1 9/2010 Brunet De Courssou
2010/0311497 A1 12/2010 Suslik
2011/0014964 A1 1/2011 Crowder, Jr.
2011/0028160 A1 2/2011 Roeding
2011/0070940 A1* 3/2011 Jaffe ..... G07F 17/3211 463/20
2011/0111856 A1 5/2011 White
2011/0130186 A1 6/2011 Chim
2011/0281624 A1 11/2011 Moody
2012/0122561 A1 5/2012 Hedrick
2012/0129610 A1 5/2012 Mazursky
2012/0225724 A1 9/2012 Barber
2013/0065676 A1* 3/2013 Owen ..... G07F 17/3258 463/27
2013/0072294 A1 3/2013 Mosley
2013/0116809 A1 5/2013 Carpenter
2013/0122978 A1 5/2013 Slomiany et al.
2013/0244751 A1 9/2013 Bennett
2013/0252704 A1* 9/2013 Gilbertson ..... G07F 17/3213 463/20
2013/0281179 A1 10/2013 Tempest
2013/0296036 A1 11/2013 Scott
2013/0331181 A1 12/2013 Newton
2013/0331968 A1 12/2013 Newton
2014/0038724 A1 2/2014 Layne, IV
2014/0051520 A1 2/2014 Davis
2014/0106866 A1 4/2014 Hardy
2014/0162787 A1 6/2014 Carpenter
2014/0194176 A1 7/2014 Robbins et al.
2014/0274308 A1* 9/2014 Guinn ..... G07F 17/3267 463/25
2014/0323199 A1 10/2014 Dimichele
2015/0018070 A1 1/2015 Meyer
2015/0099576 A1 4/2015 Anderson
2015/0199878 A1 7/2015 Wright
2015/0348361 A1 12/2015 Adiraju
2015/0355727 A1 12/2015 Hu
2015/0356815 A1 12/2015 Kim
2016/0063807 A1 3/2016 Bennett
2016/0104344 A1* 4/2016 Meyer ..... G07F 17/34 463/20
2016/0140807 A1 5/2016 Chase
2016/0275757 A1 9/2016 Decasa, Jr.
2016/0284157 A1 9/2016 Marrinson
2016/0328918 A1 11/2016 De Waal et al.
2017/0161999 A1 6/2017 Givant
2017/0200349 A1 7/2017 Englman
2017/0323528 A1 11/2017 Arnone
2018/0052582 A1 2/2018 Hilbert et al.
2018/0089953 A1 3/2018 Palmisano
2018/0089954 A1 3/2018 Carpenter
2018/0095616 A1 4/2018 Valdivia
2018/0130312 A1 5/2018 Cire
2018/0146206 A1 5/2018 Weekes
2019/0066446 A1* 2/2019 Mariscal ..... G07F 17/3267
2019/0073859 A1 3/2019 Penacho
2019/0080562 A1 3/2019 Jungmann
2019/0139366 A1 5/2019 Davis
2019/0244482 A1 8/2019 Washington
2019/0262717 A1 8/2019 Thielbar
2019/0333314 A1 10/2019 Henshaw
2019/0340883 A1 11/2019 Arnone
2019/0378379 A1 12/2019 Satterlie
2020/0043293 A1 2/2020 Nelson

(56) References Cited

U.S. PATENT DOCUMENTS

| | | | |
|---|---|---|---|
| 2020/0043294 | A1 | 2/2020 | Davis |
| 2020/0279451 | A1 | 9/2020 | La Guardia |

FOREIGN PATENT DOCUMENTS

| | | | |
|---|---|---|---|
| AU | 1997029346 | A1 | 11/1997 |
| AU | 1997030070 | A1 | 11/1997 |
| AU | 1997035809 | A1 | 1/1998 |
| AU | 700667 | B2 | 1/1999 |
| AU | 2001036378 | A1 | 5/2001 |
| AU | 2001294751 | A1 | 6/2002 |
| AU | 2002311978 | A1 | 12/2002 |
| AU | 755912 | B2 | 1/2003 |
| AU | 2002250161 | A1 | 7/2003 |
| AU | 2003281244 | A1 | 1/2004 |
| AU | 2004904539 | | 8/2004 |
| AU | 2005203403 | A1 | 2/2006 |
| AU | 2005285317 | A1 | 3/2006 |
| AU | 2002306874 | B2 | 6/2006 |
| AU | 2006200237 | A1 | 8/2006 |
| AU | 2007200711 | A1 | 10/2007 |
| AU | 2008100162 | B4 | 4/2008 |
| AU | 2008100163 | B4 | 4/2008 |
| AU | 2006208418 | B2 | 11/2008 |
| AU | 2007211906 | B2 | 2/2009 |
| AU | 2005235004 | B2 | 4/2009 |
| AU | 2008323670 | B2 | 5/2009 |
| AU | 2007216930 | B2 | 3/2010 |
| AU | 2007237214 | B2 | 3/2010 |
| AU | 2008200060 | B2 | 3/2010 |
| AU | 2004267734 | B2 | 7/2010 |
| AU | 2010200449 | A1 | 9/2010 |
| AU | 2005270750 | B2 | 12/2010 |
| AU | 2010202077 | A1 | 12/2010 |
| AU | 2004267733 | B2 | 1/2011 |
| AU | 2004267746 | B2 | 1/2011 |
| AU | 2005203404 | B2 | 3/2011 |
| AU | 2011200529 | A1 | 3/2011 |
| AU | 2010246507 | A1 | 6/2011 |
| AU | 2007200050 | B2 | 9/2011 |
| AU | 2006302141 | B2 | 1/2012 |
| AU | 2005248969 | B2 | 2/2012 |
| AU | 2011205125 | A1 | 3/2012 |
| AU | 2011200434 | B2 | 11/2012 |
| AU | 2010202282 | B2 | 1/2013 |
| AU | 2012268860 | A1 | 1/2013 |
| AU | 2008312413 | B2 | 9/2013 |
| AU | 2013254911 | A1 | 11/2013 |
| AU | 2014900096 | | 1/2014 |
| AU | 2013202667 | B2 | 1/2015 |
| AU | 2015201979 | A1 | 5/2015 |
| AU | 2012326136 | B2 | 6/2015 |
| AU | 2015200050 | A1 | 7/2015 |
| AU | 2013213728 | B2 | 1/2016 |
| AU | 2011307385 | B2 | 3/2016 |
| AU | 2016203321 | A1 | 6/2016 |
| AU | 2016204577 | A1 | 7/2016 |
| AU | 2014395471 | A1 | 1/2017 |
| AU | 2014317574 | B2 | 6/2017 |
| AU | 2014317575 | B2 | 6/2017 |
| AU | 2016349725 | A1 | 6/2018 |
| AU | 2018203786 | A1 | 6/2018 |
| AU | 2018203839 | A1 | 6/2018 |
| CA | 2340562 | A1 | 8/2002 |
| CA | 2536018 | A1 | 3/2005 |
| CA | 2920520 | A1 | 3/2005 |
| CA | 2538706 | A1 | 4/2005 |
| CA | 2259197 | C | 9/2005 |
| CA | 2253884 | C | 11/2005 |
| CA | 2563942 | A1 | 11/2005 |
| CA | 2580187 | A1 | 3/2006 |
| CA | 2522944 | A1 | 7/2006 |
| CA | 2527367 | A1 | 5/2007 |
| CA | 2527416 | A1 | 5/2007 |
| CA | 2403035 | C | 7/2007 |
| CA | 2572719 | A1 | 7/2007 |
| CA | 2604412 | A1 | 4/2008 |
| CA | 2617034 | A1 | 7/2008 |
| CA | 2691337 | A1 | 8/2010 |
| CA | 2812377 | A1 | 4/2012 |
| CA | 2838347 | A1 | 12/2012 |
| CA | 2852464 | A1 | 4/2013 |
| CA | 2876890 | A1 | 7/2015 |
| CA | 2947448 | A1 | 11/2015 |
| CA | 2956084 | A1 | 1/2016 |
| CA | 2535880 | C | 4/2016 |
| CA | 2599635 | C | 8/2016 |
| CA | 2535838 | C | 9/2016 |
| CA | 2941629 | A1 | 3/2017 |
| CA | 3004490 | A1 | 5/2017 |
| CA | 3017742 | A1 | 9/2017 |
| CA | 3017745 | A1 | 9/2017 |
| CA | 2655095 | C | 4/2018 |
| CN | 1853203 | A | 10/2006 |
| CN | 1853204 | A | 10/2006 |
| CN | 1853205 | A | 10/2006 |
| CN | 101018592 | A | 8/2007 |
| CN | 101043923 | A | 9/2007 |
| CN | 101044523 | A | 9/2007 |
| CN | 101044525 | A | 9/2007 |
| CN | 101321564 | B | 7/2011 |
| DE | 19740287 | A1 | 3/1998 |
| EP | 1021228 | A4 | 1/2001 |
| EP | 1296294 | A3 | 2/2004 |
| EP | 1644902 | A2 | 4/2006 |
| EP | 1656647 | A1 | 5/2006 |
| EP | 1656648 | A1 | 5/2006 |
| EP | 1677263 | A3 | 4/2007 |
| EP | 1794721 | A1 | 6/2007 |
| EP | 1903522 | A1 | 3/2008 |
| EP | 1912185 | A1 | 4/2008 |
| EP | 1933960 | A2 | 6/2008 |
| EP | 2003630 | A1 | 12/2008 |
| EP | 1740281 | A4 | 2/2009 |
| EP | 1814091 | A3 | 2/2009 |
| EP | 2218487 | A3 | 8/2010 |
| EP | 2435995 | A1 | 4/2012 |
| EP | 2723462 | A4 | 11/2014 |
| EP | 2621595 | A4 | 6/2015 |
| EP | 3171951 | A4 | 12/2017 |
| EP | 3149713 | A4 | 2/2018 |
| EP | 3429710 | A2 | 1/2019 |
| EP | 3429711 | A1 | 1/2019 |
| GB | 2387950 | A | 10/2003 |
| GB | 0409224D | | 4/2004 |
| GB | 2401063 | B | 10/2006 |
| GB | 2427149 | B | 3/2007 |
| HK | 1237704 | A | 4/2018 |
| IL | 216538 | A | 2/2012 |
| IN | 201847034966 | A | 9/2018 |
| JP | 2007502658 | A | 2/2007 |
| JP | 2007502659 | A | 2/2007 |
| JP | 2007502661 | A | 2/2007 |
| JP | 5941152 | B2 | 6/2016 |
| JP | 2017518850 | A | 7/2017 |
| MO | I000434 | A | 2/2008 |
| MO | I000877 | A | 3/2009 |
| MO | I001296 | C | 5/2016 |
| MO | I001298 | C | 5/2016 |
| NZ | 703662 | A | 7/2015 |
| PH | 12018501052 | A1 | 1/2019 |
| RU | 96117375 | C1 | 9/1999 |
| SG | 131166 | A1 | 5/2007 |
| SG | 11201401444 | | 5/2014 |
| SG | 10201500175 | | 8/2015 |
| SG | 11201803977 | | 6/2018 |
| TW | 573262 | B | 1/2004 |
| WO | 1997027921 | A1 | 8/1997 |
| WO | 1997039811 | A1 | 10/1997 |
| WO | 1997041933 | A1 | 11/1997 |
| WO | 1998000210 | A1 | 1/1998 |
| WO | 2001032276 | A3 | 2/2002 |
| WO | 2003059472 | A1 | 7/2003 |
| WO | 2002094399 | A8 | 8/2003 |

(56) References Cited

FOREIGN PATENT DOCUMENTS

| | | | |
|---|---|---|---|
| WO | 2002027676 | A8 | 9/2003 |
| WO | 2003083796 | A1 | 10/2003 |
| WO | 2004004853 | A2 | 1/2004 |
| WO | 2005020165 | A1 | 3/2005 |
| WO | 2005020166 | A1 | 3/2005 |
| WO | 2005020164 | A3 | 4/2005 |
| WO | 2005030353 | A3 | 4/2005 |
| WO | 2005102480 | A1 | 11/2005 |
| WO | 2006015442 | A1 | 2/2006 |
| WO | 2006031439 | A1 | 3/2006 |
| WO | 2005110563 | A3 | 1/2007 |
| WO | 2007044785 | A3 | 4/2007 |
| WO | 2007050119 | A3 | 7/2007 |
| WO | 2007087297 | A3 | 7/2008 |
| WO | 2007146791 | A3 | 12/2008 |
| WO | 2009006274 | A1 | 1/2009 |
| WO | 2009108805 | A3 | 3/2009 |
| WO | 2009052300 | A1 | 4/2009 |
| WO | 2009062187 | A1 | 5/2009 |
| WO | 2009086466 | A3 | 7/2009 |
| WO | 2010011673 | A1 | 1/2010 |
| WO | 2009135086 | A3 | 2/2010 |
| WO | 2010054061 | A1 | 5/2010 |
| WO | 2010098808 | A1 | 9/2010 |
| WO | 2010137010 | A1 | 12/2010 |
| WO | 2011019949 | A9 | 11/2011 |
| WO | 2012044559 | A1 | 4/2012 |
| WO | 2013059372 | A3 | 4/2013 |
| WO | 2013052453 | A3 | 5/2014 |
| WO | 2014074271 | A1 | 5/2014 |
| WO | 2014210080 | A1 | 12/2014 |
| WO | 2015172060 | A1 | 11/2015 |
| WO | 2015183335 | A8 | 12/2015 |
| WO | 2016014266 | A1 | 1/2016 |
| WO | 2017079706 | A1 | 5/2017 |
| WO | 2017160910 | A1 | 9/2017 |
| WO | 2017160917 | A3 | 12/2017 |
| WO | 2019125422 | A1 | 6/2019 |
| WO | 2019168646 | A1 | 9/2019 |
| ZA | 201500185 | B | 12/2015 |

OTHER PUBLICATIONS

"Gold Stacks 88 Lunar Festival Slot—Nice Session, All Features!" Feb. 14, 2019, YouTube, site visited May 27, 2020: https://www.youtube.conn/watch?v=kusOLt2fvM4 (Year: 2019).

"Figures and Polygons" Sep. 15, 2008, Themathleague, site visited May 27, 2020: https://www.mathleague.com/index.php/ connponent/content/article/31-nnathleaguewebsite/genera1/75-figuresandpolygons#octagon (Year: 2018).

"Catherine Wheels, Fireworks, android/ios game" Oct. 24, 2015, YouTube, site visited May 27, 2020: https://www.youtube.com/watch?v=DzCYicyl FJA (Year: 2015).

"Golden Firework Video Slot Casino Game with a "Mega Win" Free Spin Bonus" Apr. 16, 2018, YouTube, site visited May 27, 2020: https://www.youtube.conn/watch?v=YgCbY7c-nYM (Year: 2018).

"Lucky Firecracker slot game [Wild Jackpots]" Jan. 30, 2015, YouTube, site visited May 27, 2020: https://www.youtube.com/watch?v=Gzfe182Qtbc (Year: 2015).

"Cashman Casino," Sep. 2018 screenshot from YouTube video. Publication date Apr. 4, 2017, 1 page.

"House of Fun," Sep. 2018 screenshot from web page: "https://www.houseoffun.com/play-now/," 1 page.

Office Action dated May 14, 2020 for U.S. Appl. No. 16/290,836 (pp. 1-5).

Office Action dated Jun. 23, 2020 for U.S. Appl. No. 29/682,179 (pp. 1-11).

"iSoftBet—Scrolls of Ra HD" May 8, 2015, YouTube, site visited Jun. 16, 2020: https://www.youtube.conn/watch?v=9ZciLdlqQNo Year: 2015).

"New Game  Fortune Scroll  Slot Lover" Feb. 11, 2019, YouTube, site visited Jun. 16, 2020: https://www.youtube.conn/watch?v=cdCsvzzRHvs&list=LLMFvEIKJd5VZ1hOwZ7BZDdQ&index=2873 (Year: 2019).

"Hot Shot Twin Fire Live Play with many features Bally Slot Machine" Jun. 8, 2017, YouTube, site visited Jun. 16, 2020: https://www.youtube.com/watch?v=b_03gJvQecw (Year: 2017).

"Traditional Torah Icon" Feb. 6, 2018, Alamy, site visited Jun. 16, 2020: https://www.alamy.com/ stock-photo-traditional-torah-icon-174149305.htnnl (Year: 2018).

"Paper Scroll Clip Art" Dec. 11, 2017, FavPNG, site visited Jun. 16, 2020: https://favpng.com/png_view/ paper-scroll-clip-art-png/DDpwDsEh (Year: 2017).

"Torah Scroll Icon" Jun. 25, 2018, Depositphotos, site visited Jun. 16, 2020: https://depositphotos.com/201375256/stock-illustration-torah-scroll-icon-outline-style.html (Year: 2018).

Notice of Allowance dated Aug. 26, 2020 for U.S. Appl. No. 16/290,836 (pp. 1-8).

Notice of Allowance dated Oct. 7, 2020 for U.S. Appl. No. 29/682,179 (pp. 1-7).

Office Action dated Aug. 18, 2020 for U.S. Appl. No. 29/703,046 (pp. 1-12).

Countdown Timer Background 10 Seconds, by Kanadaka, YouTube [online], published on Dec. 16, 2013, [retrieved on Aug. 13, 2020], retrieved from the Internet <URL: https://www.youtube.com/watch?v=AwOYH3RDUe4> (Year: 2013).

3 2 1 Go! Countdown Green Screen, by Da24Gemini, YouTube [online], published on Sep. 15, 2012, [retrieved on Aug. 13, 2020], retrieved from the Internet <URL: https://www.youtube.com/watch?v=WJhxCcx1 M4g> (Year: 2012).

Candy Words—Match Word Puzzle Game, by Homer S, YouTube [online], published on Mar. 5, 2019, [retrieved on Aug. 13, 2020], retrieved from the Internet <URL: https://www.youtube.com/watch?v=4TsGNDLrpWk> (Year: 2019).

Legato, Frank, "Tourney Time", Global Gaming Business Magazine, Mar. 22, 2019, retrieved from Internet on Oct. 7, 2019, https://ggbmagazine.com/article/tourney-time/, 20 pages.

Notice of Allowance dated Jan. 7, 2021 for U.S. Appl. No. 29/703,046 (pp. 1-9).

Office Action dated Jan. 27, 2021 for U.S. Appl. No. 16/290,838 (pp. 1-9).

International Search Report and Written Opinion for App. No. PCT/US19/53398, dated Jan. 6, 2020, 9 pages.

International Search Report and Written Opinion for App. No. PCT/US19/53407, dated Jan. 9, 2020, 8 pages.

International Preliminary Report on Patentability for App. No. PCT/US2019/053407, dated Apr. 15, 2021, 8 pages.

Office Action dated May 11, 2021 for U.S. Appl. No. 16/946,113 (pp. 1-14).

Notice of Allowance dated May 19, 2021 for U.S. Appl. No. 29/703,046 (pp. 1-8).

* cited by examiner

FIG. 12A
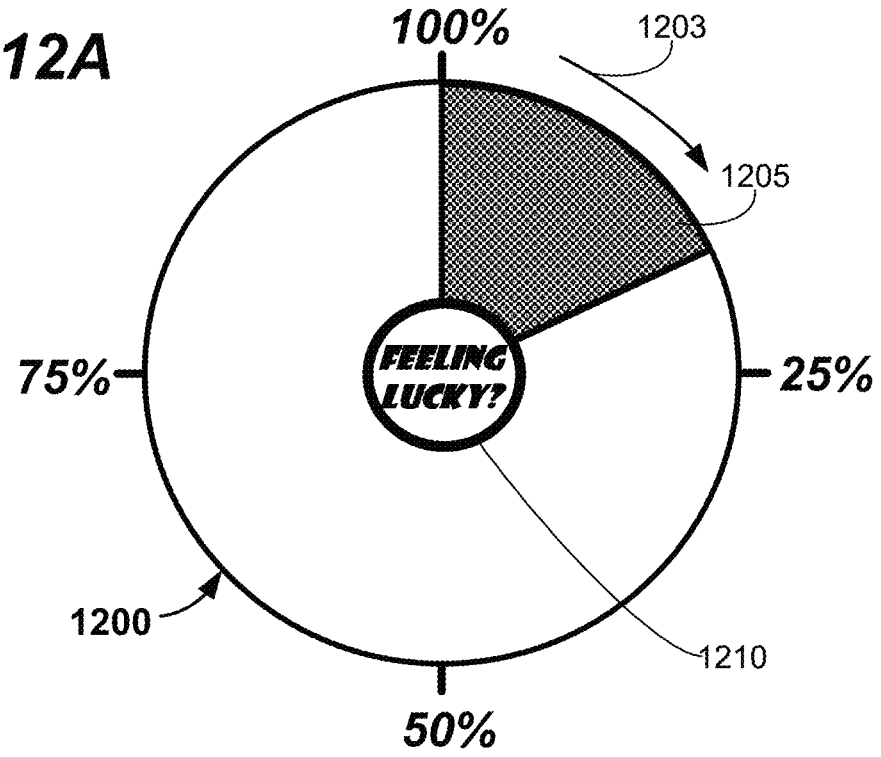
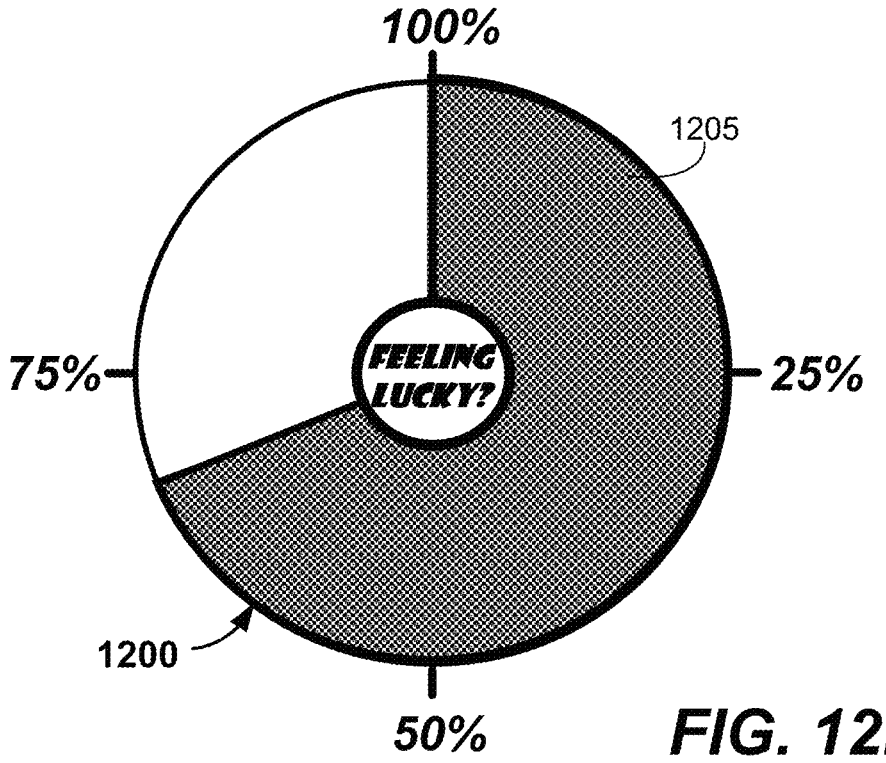
FIG. 12B

FIG. 12C
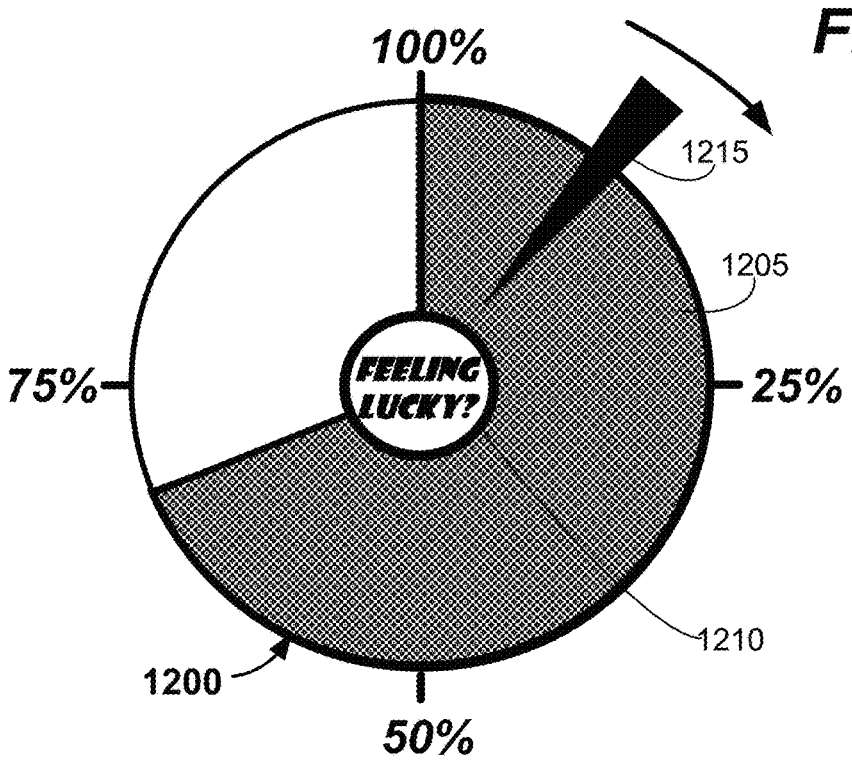
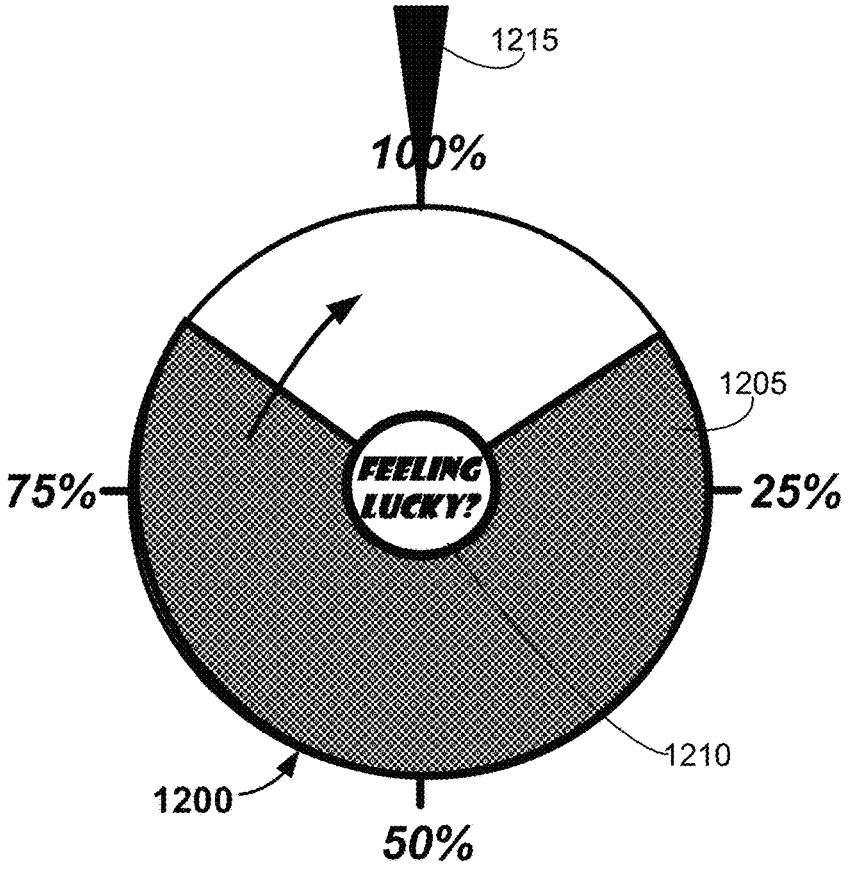
FIG. 12D

FIG. 13A
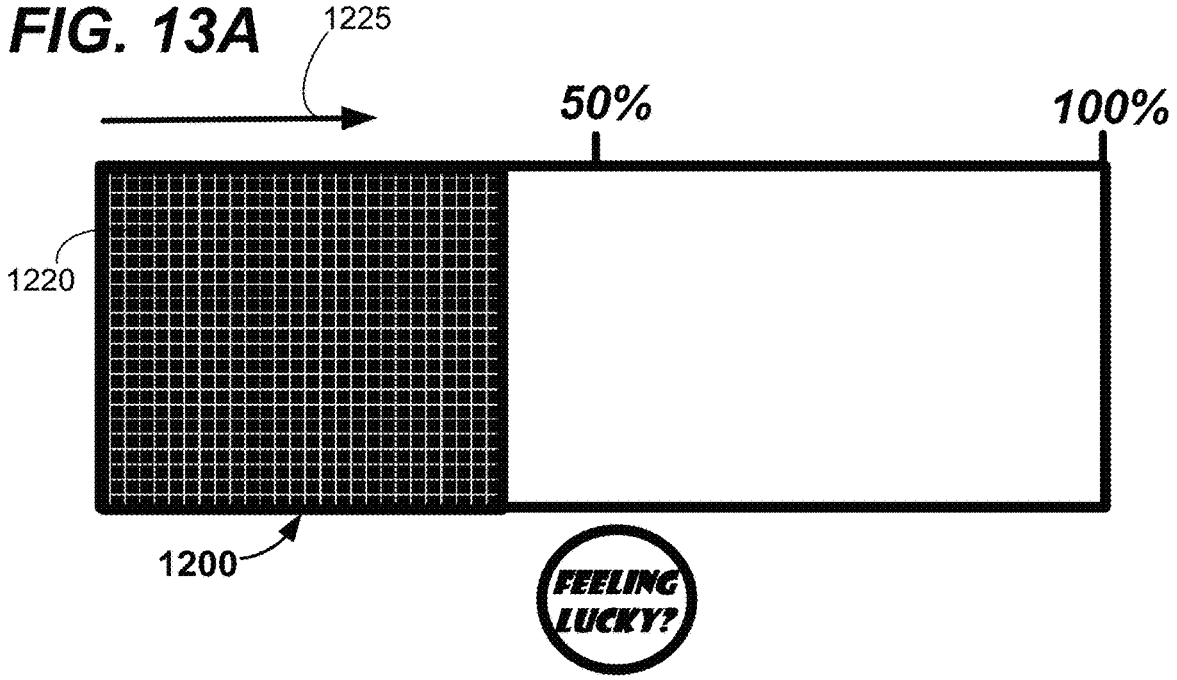
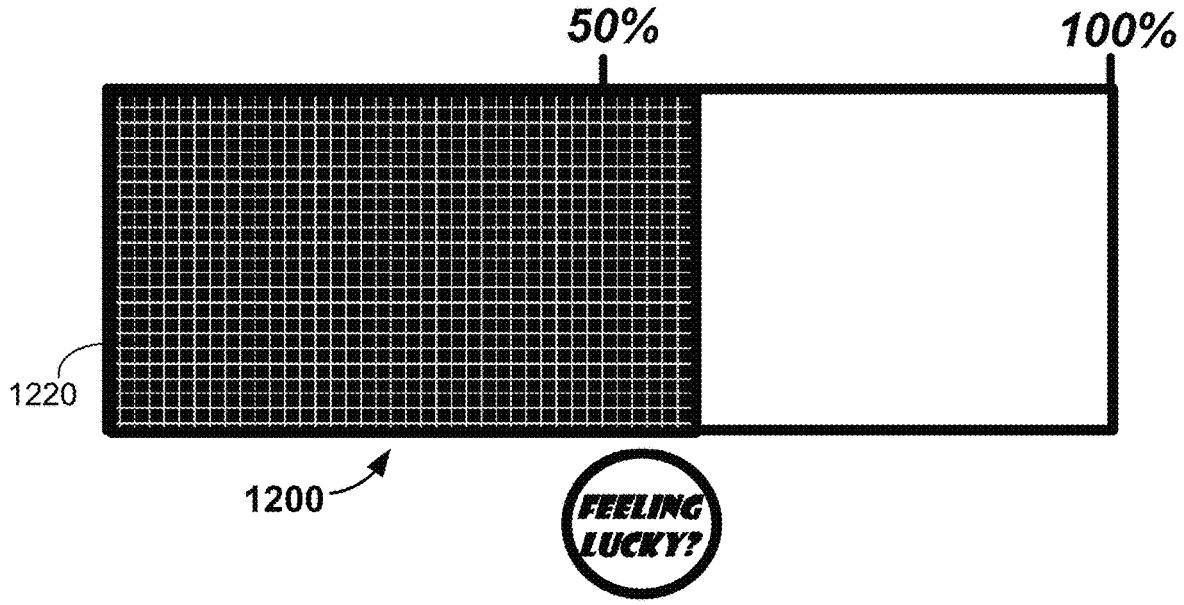
FIG. 13B

INDIVIDUAL METAMORPHIC LINKED JACKPOTS

CROSS-REFERENCE TO RELATED APPLICATIONS

This application is related to U.S. patent application Ser. No. 16/290,836, filed on the same day of the present application and entitled "CONTROLLING AN ELECTRONIC GAMING MACHINE TO PROVIDE A BONUS FEATURE OPPORTUNITY," to U.S. patent application Ser. No. 16/290,838, filed on the same day of the present application and entitled "DIGITAL LOBBY AND MULTI-GAME METAMORPHICS," to U.S. patent application Ser. No. 29/682,178, filed on the same day of the present application and entitled "DISPLAY SCREEN OR PORTION THEREOF WITH TRANSITIONAL GRAPHICAL USER INTERFACE," and to U.S. patent application Ser. No. 29/682,179, filed on the same day of the present application and entitled "DISPLAY SCREEN OR PORTION THEREOF WITH TRANSITIONAL GRAPHICAL USER INTERFACE," all of which are hereby incorporated by reference.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

At least some aspects of the present disclosure may be implemented via apparatus. For example, one or more devices may be configured for performing, at least in part, the methods disclosed herein. In some implementations, the apparatus may be an electronic gaming device. The electronic gaming device may include a display system that includes one or more displays, an interface system including one or more user interfaces and a control system that includes one or more processors.

The interface system may include one or more network interfaces, one or more interfaces between the control system and a memory system, one or more interfaces between the control system and another device, one or more user interfaces and/or one or more external device interfaces. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components. Accordingly, in some implementations the control system may include one or more processors and one or more non-transitory storage media operatively coupled to the one or more processors.

The control system may, for example, be configured for controlling the display system to present first visual effects corresponding to one or more instances of a game. The first visual effects may, for example, include game events. The control system may be configured for controlling the display system to present second visual effects corresponding to a metamorphic image. In some examples, the metamorphic image may correspond to an award. Presenting the second visual effects may involve indicating changes in the metamorphic image in response to game event data corresponding to one or more games presented on the electronic gaming device. According to some examples, presenting the second visual effects may involve indicating changes in the metamorphic image in response to networked gaming device game event data received via the interface system. The networked gaming device game event data may correspond to one or more games presented on one or more other electronic gaming devices.

According to some examples, the control system may be configured for determining whether the award will be granted. The control system may be configured for controlling the display system to present third visual effects corresponding to whether the award will be granted. In some examples, the metamorphic image may correspond to a probability of the award being granted.

According to some examples, the metamorphic image may include a string of firecrackers. In some instances, the metamorphic image may include a sector of a circle.

In some implementations, the metamorphic image may correspond to a number of game events that have occurred since the award has been granted. The game events may, for example, include local gaming device game events and networked gaming device game events. In some examples, the award may include a credit award. The credit award may, for example, include a progressive jackpot award.

Alternatively, or additionally, the award may include a feature award. The feature award may, for example, include an award of one or more bonus games. According to some examples, the metamorphic image may correspond to an accumulation of feature award credits towards an automatic feature award. In some such examples, the first visual effects may include game play items that correspond to the feature award credits.

According to some examples, the control system may be configured for receiving an indication, via the interface system, of a player's initiation of an attempt to trigger a grant of the feature award. The indication may, in some instances, be received at a time during which less than a number of feature award credits necessary for an automatic grant of the feature award has been accumulated. According to some such examples, the control system may be configured for determining whether a feature award will be granted and for controlling the display system to present fourth visual effects corresponding to whether a feature award has been granted. In some such examples, upon determining that a feature award will be granted, the control system may be further configured for controlling the display system to present fifth visual effects corresponding to a feature award.

At least some aspects of the present disclosure may be implemented via methods. For example, some methods may involve controlling, via a control system of an electronic gaming device, a display system of the electronic gaming device to present first visual effects corresponding to one or more instances of a game. The first visual effects may include game events. According to some examples, the method may involve controlling, via the control system, the display system to present second visual effects corresponding to a metamorphic image. The metamorphic image may, in some examples, correspond to an award. Presenting the second visual effects may, in some instances, involve indicating changes in the metamorphic image in response to game event data corresponding to one or more games presented on the electronic gaming device. In some examples, presenting the second visual effects may involve indicating changes in the metamorphic image in response to networked gaming device game event data received via the interface system. The networked gaming device game event data may correspond to one or more games presented on one or more other electronic gaming devices.

According to some examples, the method may involve determining, via the control system, whether the award will be granted. In some instances, the method may involve controlling, via the control system, the display system to present third visual effects corresponding to whether the award will be granted.

In some implementations, the metamorphic image may correspond to a number of game events that have occurred since the award has been granted. The game events may, for example, include local gaming device game events and networked gaming device game events.

In some instances, the metamorphic image may correspond to a probability of the award being granted. However, in alternative examples, the metamorphic image may not correspond to a probability of the award being granted.

According to some examples, the metamorphic image may include a string of firecrackers. In some instances, the metamorphic image may include a sector of a circle.

In some implementations, the metamorphic image may correspond to a number of game events that have occurred since the award has been granted. The game events may, for example, include local gaming device game events and networked gaming device game events. In some examples, the award may include a credit award. The credit award may, for example, include a progressive jackpot award.

Alternatively, or additionally, the award may include a feature award. The feature award may, for example, include an award of one or more bonus games. According to some examples, the metamorphic image may correspond to an accumulation of feature award credits towards an automatic feature award. In some such examples, the first visual effects may include game play items that correspond to the feature award credits.

According to some examples, the method may involve receiving an indication, via an interface system of the electronic gaming device, of a player's initiation of an attempt to trigger a grant of the feature award. The indication may, in some instances, be received at a time during which less than a number of feature award credits necessary for an automatic grant of the feature award has been accumulated. In some implementations, the method may involve determining whether a feature award will be granted. Some implementations may involve controlling the display system to present fourth visual effects corresponding to whether a feature award has been granted.

Some or all of the methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, various innovative aspects of the subject matter described in this disclosure can be implemented in one or more non-transitory media having software stored thereon. The software may, for example, include instructions for controlling at least one device to process audio data. The software may, for example, be executable by one or more components of a control system such as those disclosed herein. The software may, for example, include instructions for performing one or more of the methods disclosed herein.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale. Like reference numbers and designations in the various drawings generally indicate like elements.

BRIEF DESCRIPTION OF THE DRAWINGS

FIGS. 12A-13D show examples of feature award credit meters.

DETAILED DESCRIPTION

Figure 1:
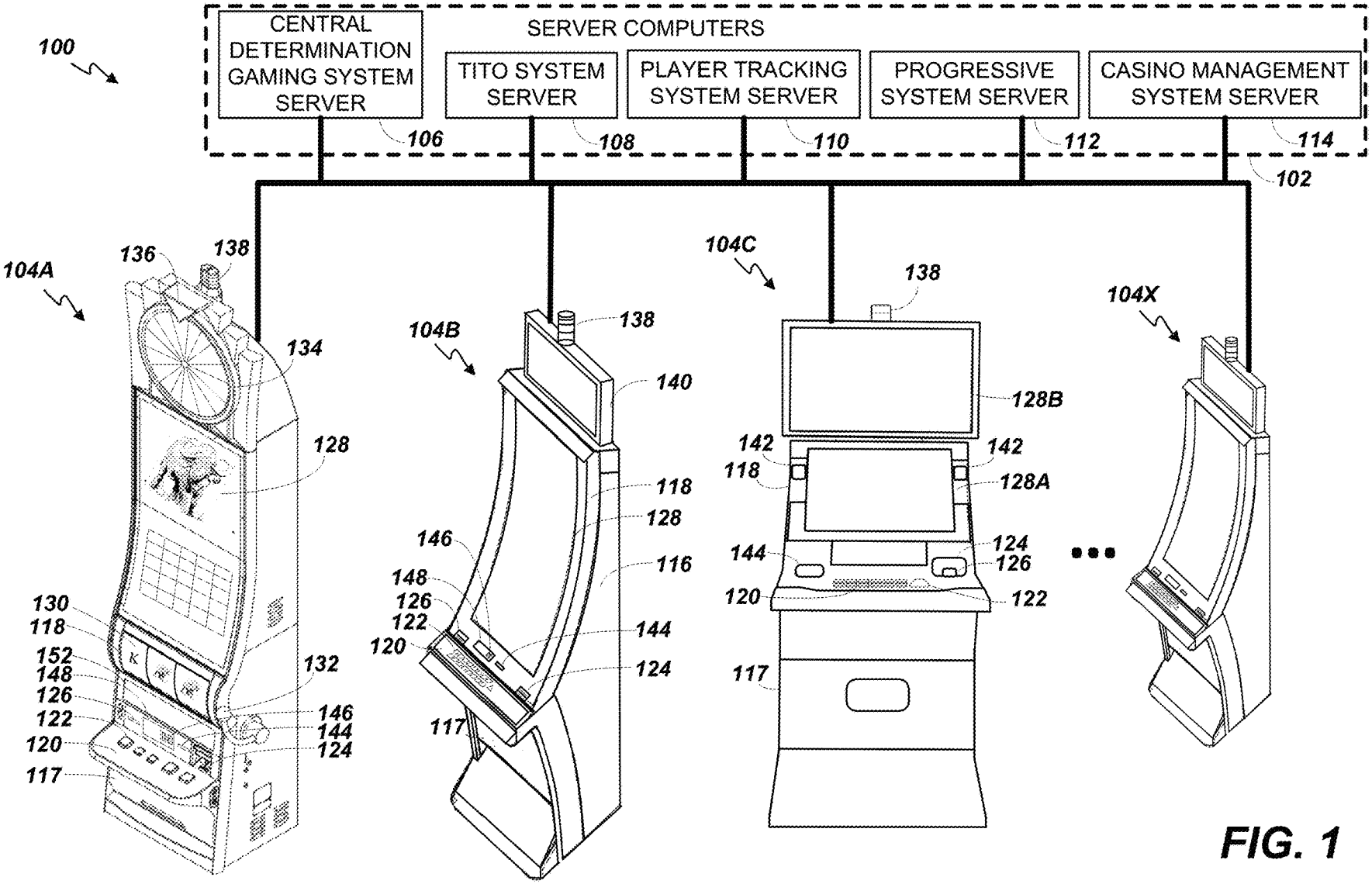
FIG. 1 is a diagram showing examples of several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices. Some examples are described below.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

Moreover, in some implementations at least some of the EGMs may be "thin-client" or "thick-client" EGMs that are not configured for stand-alone determination of game outcomes, etc. Such client EGMs may be configured for communication with one or more of the different server computers 102 described herein, including but not limited to the central determination gaming system server 106. Some such client EGMs may, for example, be configured to accept tickets and/or cash (e.g., via a bill validator that also functions as a ticket reader) to load credits onto the client EGM, a "ticket-out" printer for outputting a credit ticket when a cash out button is pressed, a player tracking card reader, etc. Some client EGMs may include a transceiver for wireless communication with a player's mobile device, (e.g., for communication with a player's smartphone, tablet and/or mobile gaming device) a keypad 146, and/or an illuminated display 148 for reading, receiving, entering, and/or displaying player tracking information. A client EGM may include a display system, an audio system, etc., for presenting attract sequences, game presentations, etc. The game presentations may include game outcomes determined by another device, such as the central determination gaming system server 106.

The server computers 102 may include a central determination gaming system server 106, a Class II bingo server (not shown), a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 117 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to present or determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor. The main display 128 may be a touchscreen display.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
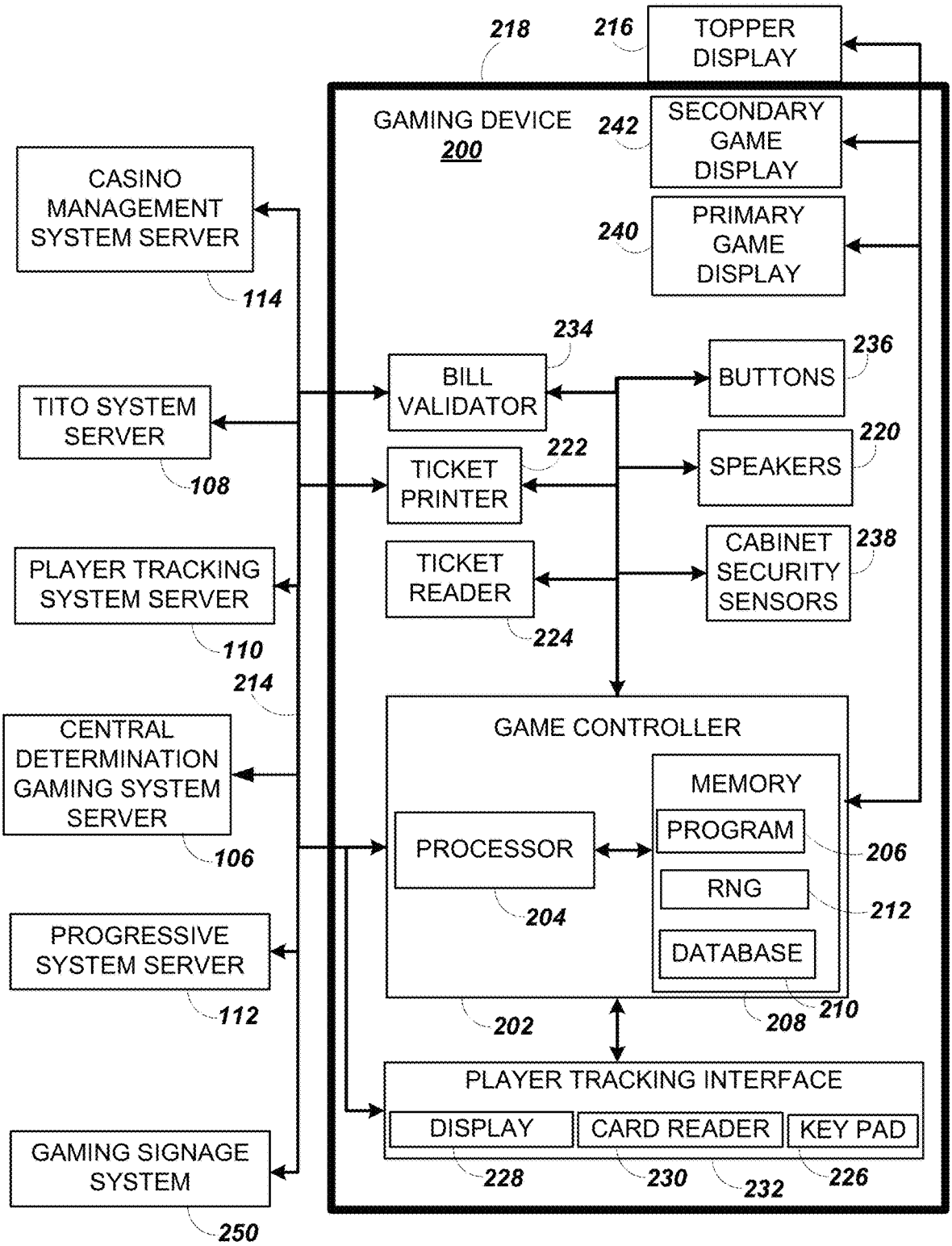
FIG. 2 is a block diagram showing examples of various functional elements of an EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 117 which opens to provide access to the interior of the gaming device 104B. The main or service door 117 is typically used by service personnel to refill the ticket-out printer 126 and collect bills and tickets inserted into the bill validator 124. The door 117 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class II or Class III, etc.

FIG. 2 is a block diagram depicting examples of internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e. a play or round of the game) may be generated on a remote gaming device such as the central determination gaming system server 106. The game instance may be communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

In this example, the gaming device 200 is also configured for communication with a gaming signage system 250 via the network 214. Various examples of gaming signage systems 250 are provided herein. According to some examples, the gaming signage system 250 may be configured for communication with other elements of a gaming system via the network 214, such as the central determination gaming system server 106, the progressive system server 112, the player tracking system server 110 the casino management system server 114 and/or the TITO system server 108.

When the player is done, he/she cashes out the credit balance (typically by pressing a cash out button to receive a ticket from the ticket printer 222). The ticket may be redeemed for money or inserted into another machine to establish a credit balance for play.

Figure 3:
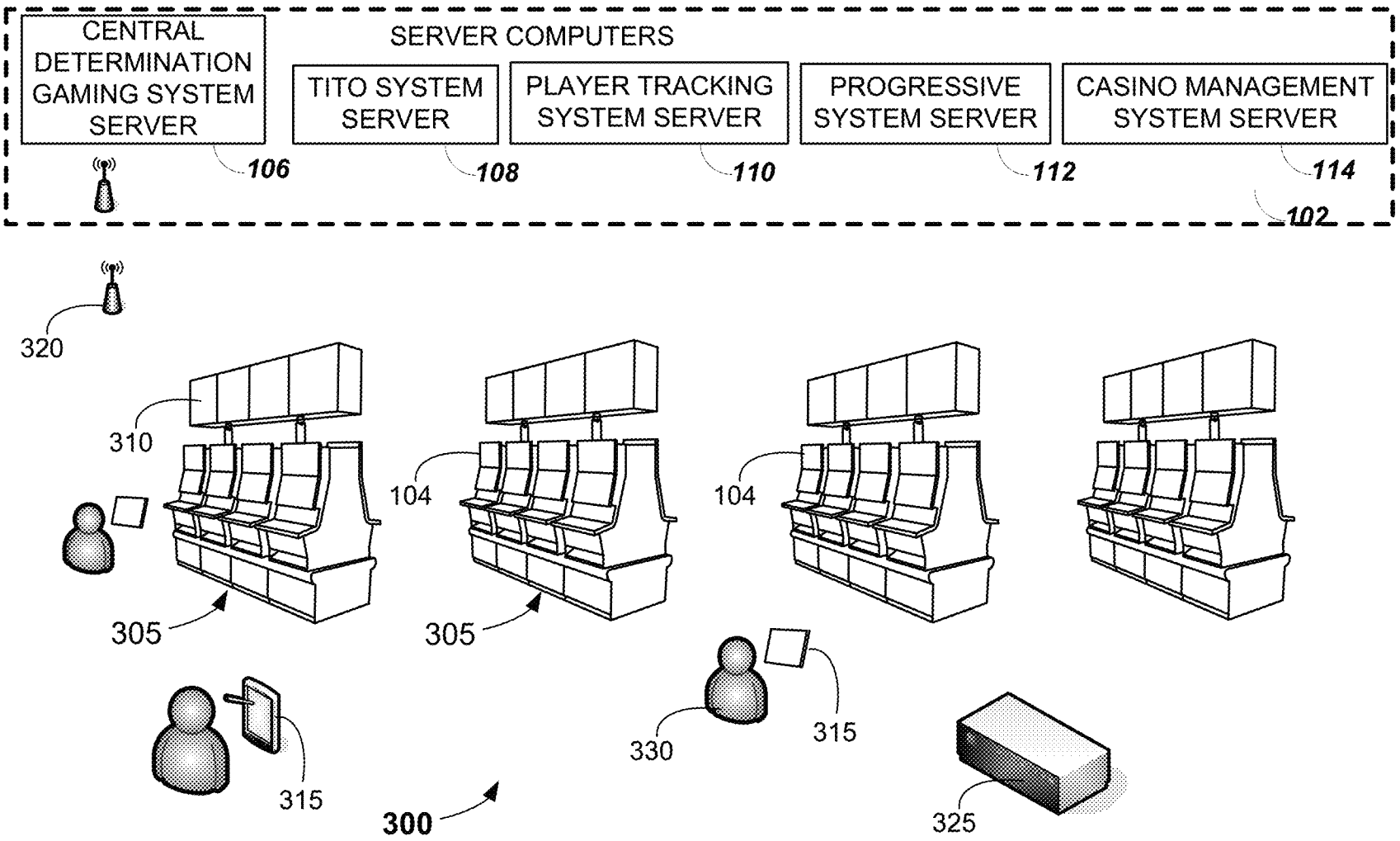
FIG. 3 depicts a casino gaming environment according to one example.

FIG. 3 depicts a casino gaming environment according to one example. In this example, the casino 300 includes banks 305 of EGMs 104. In this example, each bank 305 of EGMs 104 includes a corresponding gaming signage system 310. According to this implementation, the casino 300 also includes mobile gaming devices 315, which are also configured to present wagering games in this example. The mobile gaming devices 315 may, for example, include tablet devices, cellular phones, smart phones and/or other handheld devices. In this example, the mobile gaming devices 315 are configured for communication with one or more other devices in the casino 300, including but not limited to one or more of the server computers 102, via wireless access points 320.

According to some examples, the mobile gaming devices 315 may be configured for stand-alone determination of game outcomes. However, in some alternative implementations the mobile gaming devices 315 may be configured to receive game outcomes from another device, such as the central determination gaming system server 106, one of the EGMs 104, etc.

Some mobile gaming devices 315 may be configured to accept monetary credits from a credit or debit card, via a wireless interface (e.g., via a wireless payment app), via tickets, via a patron casino account, etc. However, some mobile gaming devices 315 may not be configured to accept monetary credits via a credit or debit card. Some mobile gaming devices 315 may include a ticket reader and/or a ticket printer whereas some mobile gaming devices 315 may not, depending on the particular implementation.

In some implementations, the casino 300 may include one or more kiosks 325 that are configured to facilitate monetary transactions involving the mobile gaming devices 315, which may include cash out and/or cash in transactions. The kiosks 325 may be configured for wired and/or wireless communication with the mobile gaming devices 315. The kiosks 325 may be configured to accept monetary credits from casino patrons 330 and/or to dispense monetary credits to casino patrons 330 via cash, a credit or debit card, via a wireless interface (e.g., via a wireless payment app), via tickets, etc. According to some examples, the kiosks 325 may be configured to accept monetary credits from a casino patron and to provide a corresponding amount of monetary credits to a mobile gaming device 315 for wagering purposes, e.g., via a wireless link such as a near-field communications link. In some such examples, when a casino patron 330 is ready to cash out, the casino patron 330 may select a cash out option provided by a mobile gaming device 315, which may include a real button or a virtual button (e.g., a button provided via a graphical user interface) in some instances. In some such examples, the mobile gaming device 315 may send a "cash out" signal to a kiosk 325 via a wireless link in response to receiving a "cash out" indication from a casino patron. The kiosk 325 may provide monetary credits to the patron 330 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 315 and/or a kiosk 325.

Some mobile gaming devices 315 may be configured for receiving and/or transmitting player loyalty information. For example, some mobile gaming devices 315 may be configured for wireless communication with the player tracking system server 110. Some mobile gaming devices 315 may be configured for receiving and/or transmitting player loyalty information via wireless communication with a patron's player loyalty card, a patron's smartphone, etc.

According to some implementations, a mobile gaming device 315 may be configured to provide safeguards that prevent the mobile gaming device 315 from being used by an unauthorized person. For example, some mobile gaming devices 315 may include one or more biometric sensors and may be configured to receive input via the biometric sensor(s) to verify the identity of an authorized patron. Some mobile gaming devices 315 may be configured to function only within a predetermined or configurable area, such as a casino gaming area.

Figure 4:
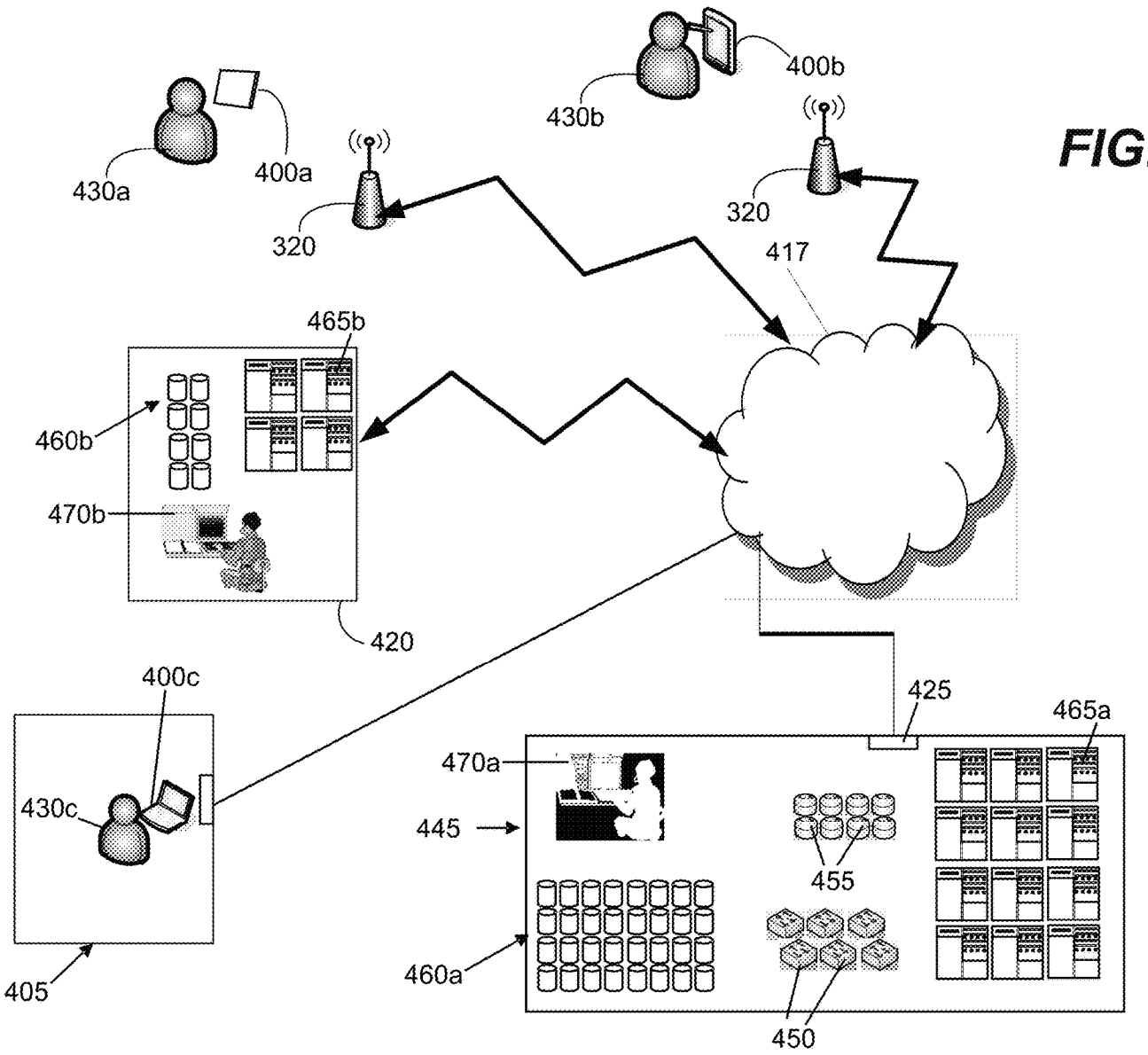
FIG. 4 is a diagram that shows examples of components of a system for providing online gaming according to some aspects of the present disclosure.

FIG. 4 is a diagram that shows examples of components of a system for providing online gaming according to some aspects of the present disclosure. As with other figures presented in this disclosure, the numbers, types and arrangements of gaming devices shown in FIG. 4 are merely shown by way of example. In this example, various gaming devices, including but not limited to end user devices (EUDs) 400*a*, 400*b* and 400*c* are capable of communication via one or more networks 417. The networks 417 may, for example, include one or more cellular telephone networks, the Internet, etc. In this example, the EUDs 400*a* and 400*b* are mobile devices: according to this example the EUD 400*a* is a tablet device and the EUD 400*b* is a smart phone. In this implementation, the EUD 400*c* is a laptop computer that is located within a residence 405 at the time depicted in FIG. 4. Accordingly, in this example the hardware of EUDs is not specifically configured for online gaming, although each EUD is configured with software for online gaming. Other implementations may include other types of EUD, some of which may be specifically configured for online gaming.

In this example, a gaming data center 445 includes various devices that are configured to provide online wagering games via the networks 417. The gaming data center 445 is capable of communication with the networks 417 via the gateway 425. In this example, switches 450 and routers 455 are configured to provide network connectivity for devices of the gaming data center 445, including storage devices 460*a*, servers 465*a* and one or more workstations 570*a*. The servers 465*a* may, for example, be configured to provide access to a library of games for online game play. In some examples, code for executing at least some of the games may initially be stored on one or more of the storage devices 460*a*. The code may be subsequently loaded onto a server 465*a* after selection by a player via an EUD and communication of that selection from the EUD via the networks 417. The server 465*a* onto which code for the selected game has been loaded may provide the game according to selections made by a player and indicated via the player's EUD. In other examples, code for executing at least some of the games may initially be stored on one or more of the servers 465*a*. Although only one gaming data center 445 is shown in FIG. 4, some implementations may include multiple gaming data centers 445.

In this example, a financial institution data center 420 is also configured for communication via the networks 417. Here, the financial institution data center 420 includes servers 465*b*, storage devices 460*b*, and one or more workstations 470*b*. According to this example, the financial institution data center 420 is configured to maintain financial accounts, such as checking accounts, savings accounts, loan accounts, etc. In some implementations one or more of the authorized users 430*a*-430*c* may maintain at least one financial account with the financial institution that is serviced via the financial institution data center 420.

According to some implementations, the gaming data center 445 may be configured to provide online wagering games in which money may be won or lost. According to some such implementations, one or more of the servers 465*a* may be configured to monitor player credit balances, which may be expressed in game credits, in currency units, or in any other appropriate manner. In some implementations, the server(s) 465*a* may be configured to obtain financial credits from and/or provide financial credits to one or more financial institutions, according to a player's "cash in" selections, wagering game results and a player's "cash out" instructions. According to some such implementations, the server(s) 465*a* may be configured to electronically credit or debit the account of a player that is maintained by a financial institution, e.g., an account that is maintained via the financial institution data center 420. The server(s) 465*a* may, in some examples, be configured to maintain an audit record of such transactions.

In some alternative implementations, the gaming data center 445 may be configured to provide online wagering games for which credits may not be exchanged for cash or the equivalent. In some such examples, players may purchase game credits for online game play, but may not "cash out" for monetary credit after a gaming session. Moreover, although the financial institution data center 420 and the gaming data center 445 include their own servers and storage devices in this example, in some examples the financial institution data center 420 and/or the gaming data center 445 may use offsite "cloud-based" servers and/or storage devices. In some alternative examples, the financial institution data center 420 and/or the gaming data center 445 may rely entirely on cloud-based servers.

One or more types of devices in the gaming data center 445 (or elsewhere) may be capable of executing middleware, e.g., for data management and/or device communication. Authentication information, player tracking information, etc., including but not limited to information obtained by EUDs 400 and/or other information regarding authorized users of EUDs 400 (including but not limited to the authorized users 430*a*-430*c*), may be stored on storage devices 460 and/or servers 465. Other game-related information and/or software, such as information and/or software relating to leaderboards, players currently playing a game, game themes, game-related promotions, game competitions, etc., also may be stored on storage devices 460 and/or servers 465. In some implementations, some such game-related software may be available as "apps" and may be downloadable (e.g., from the gaming data center 445) by authorized users.

In some examples, authorized users and/or entities (such as representatives of gaming regulatory authorities) may obtain gaming-related information via the gaming data center 445. One or more other devices (such EUDs 400 or devices of the gaming data center 445) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Some games involve what is sometimes referred to as a "metamorphic," a "game metamorphic," a "metamorphic image," a "metamorphic meter," etc., which change or metamorphose over time in response to gaming events. In some wagering game examples, a metamorphic image may change in response to the increasing value of a progressive. In some such examples, a metamorphic image may change in response to the increasing value indicated on a progressive meter. For example, a metamorphic image may increase in size in accordance with an increasingly larger value indicated on a progressive meter. Alternatively, or additionally, a metamorphic image may change color in accordance with an increasingly larger value indicated on a progressive meter. For example, the metamorphic image may change from a relatively "cooler" color (such as green or blue) to a relatively "hotter" color (such as yellow, orange or red) in accordance with an increasingly larger value indicated on a progressive meter.

Players like some aspects of existing wagering games that involve metamorphic images. For example, changes in the metamorphic image may enhance player excitement, because the increasing value of a progressive may be indicated not merely by a larger number, but also by a changing image to which the player may respond in a relatively more intuitive manner. Accordingly, existing wagering games that involve one or more metamorphic images can provide benefits both to players and to casinos.

However, some players find other aspects of existing wagering games that involve metamorphic images to be less than optimal. For example, some existing wagering games provide metamorphic images that are associated with a feature, such as a bonus game. It may not always be possible for a player to determine the end state of some metamorphic images. One example is a "zoom in" metamorphic image. A player may not really know what the last state of the metamorphic image will be. The player may wonder, "Will the metamorphic image zoom further?"

Particular aspects of the subject matter described in this disclosure can be implemented to realize one or more of the following potential advantages. In some implementations, a metamorphic image may change in response to game events of a local gaming device, such as a local EGM, as well as to game events of one or more other gaming devices that are configured for communicating with the local gaming device via a network, such as networked EGMs. The game events may, for example, involve occurrences of slot reel symbols, card image symbols, and/or combinations of slot reel symbols or card image symbols. In some examples, a game event may involve the initiation of a process for obtaining a randomly-determined outcome that is triggered by an occurrence of a symbol or of a combination of symbols. In some examples, the game events may involve occurrences of a wild symbol.

According to some such examples, one or more metamorphic images may change according to a number of game events that have occurred since the credits corresponding to the progressive meter have been awarded. The game events may, in some examples, include local EGM game events and networked EGM game events.

Some disclosed metamorphic images are associated with a particular prize or award instead of, or in addition to, a feature. The state of the metamorphic image(s) may or may not correspond to the probability of an award being granted, depending on the particular implementation. However, state of the metamorphic image(s) may nonetheless appear to correspond to the probability of an award being granted. In some instances, the state of the metamorphic image(s) may appear to correspond to the duration of time since an award has been granted. Depending on the state of a metamorphic image, a player may believe that a corresponding award is relatively more or relatively less likely to be granted.

The award may, for example, be a credit award, such as a progressive jackpot award. In some such examples, the metamorphic image may be associated with a progressive meter that indicates a potential progressive jackpot award. Some examples involve simultaneously presenting more than one metamorphic image. According to some such examples, each metamorphic image may correspond to a different progressive meter. The metamorphic images may or may not indicate the actual probability of being awarded the credits corresponding to the progressive meter, depending on the particular implementation.

Such implementations may enhance player excitement, because each player of a participating networked EGM can gauge the collective game event "contributions" of other participating players by the appearance of the metamorphic image(s). For example, if the state of a metamorphic image actually does correspond to the probability of an award has been granted, a player may decide to continue playing because it may appear that otherwise some other participating player may soon be granted the award.

Some disclosed metamorphic images may present clear beginning and end states. For example, disclosed metamorphic images may depict a string of firecrackers. The beginning state may be a metamorphic image having no firecrackers lit. The end state may be a metamorphic image having all of the firecrackers lit. Even if the state of a metamorphic image does not directly correspond to the probability of a corresponding progressive being awarded, a player may nonetheless be motivated to continue playing if, for example, the player can see—based on the state of a metamorphic image—that a corresponding award seems not to have been granted for a long time. The player may decide to continue playing because the player may believe that otherwise some other participating player may soon be granted the award.

Figure 5:
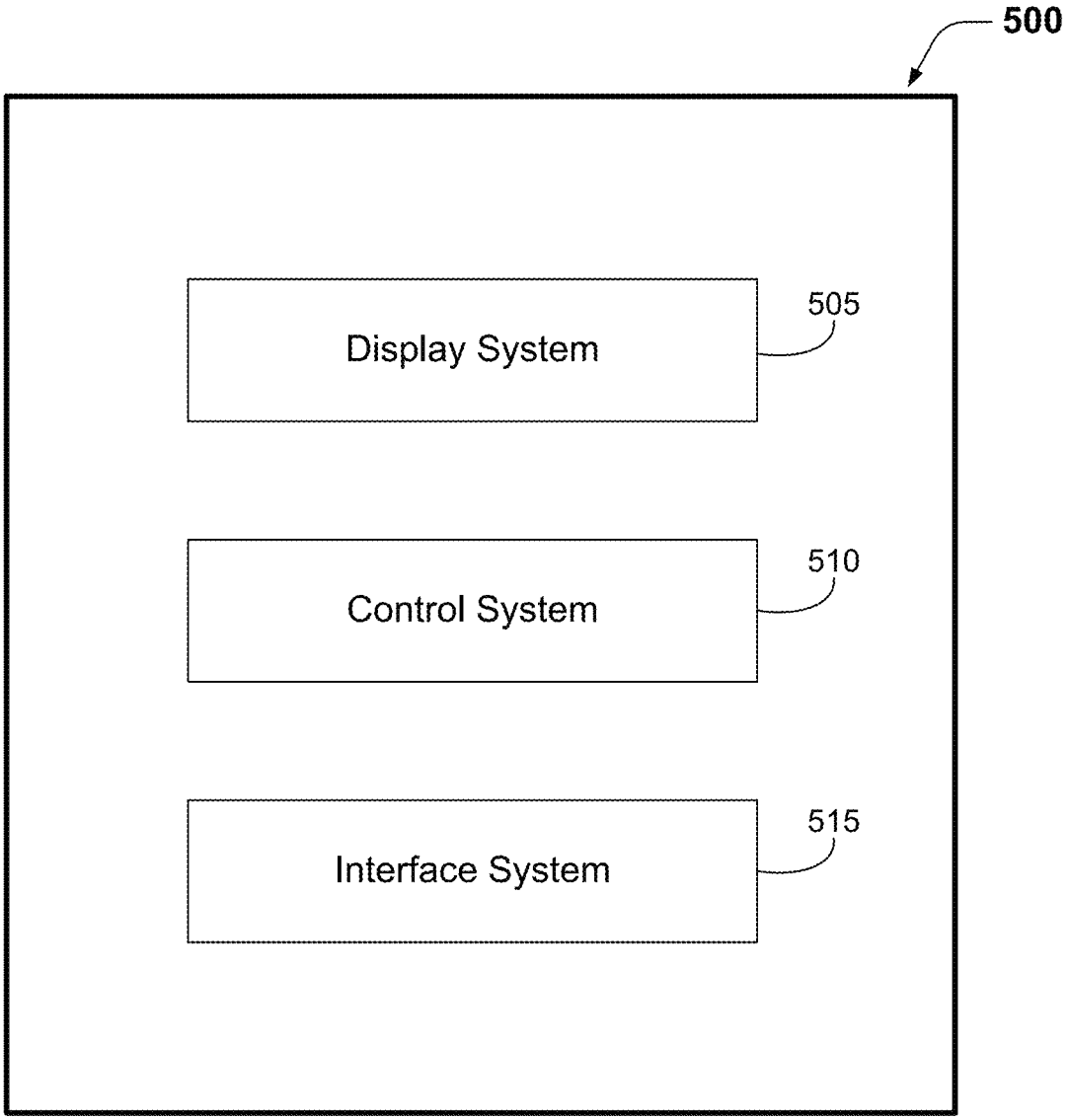
FIG. 5 is a block diagram that shows blocks of an apparatus according to one example.

FIG. 5 is a block diagram that shows blocks of an apparatus according to one example. According to some examples, the apparatus 500 may be, or may include, a gaming device. In some examples, the apparatus 500 may be an EGM such as those described above with reference to FIGS. 1 and 2. However, in alternative examples, the apparatus 500 may be a mobile device such as described above with reference to FIG. 3 or an EUD as described above with reference to FIG. 4. In this example, the apparatus 500 includes a display system 505 and a control system 510 that is configured to communicate with the display system 505. In this example, the control system 510 is configured to communicate with the display system 505 via wired communication, e.g., via electrical signals. In alternative implementations, the control system 510 may be configured to communicate with the display system 505 via wireless communication. Accordingly, at least a portion of the control system 510 may be coupled to the display system 505. As used herein, the term "coupled to" has a meaning that could include being physically coupled for wired communication or being configured for wireless communication.

The control system 510 may include one or more general purpose single- or multi-chip processors, digital signal processors (DSPs), application specific integrated circuits (ASICs), field programmable gate arrays (FPGAs) or other programmable logic devices, discrete gates or transistor logic, discrete hardware components, or combinations thereof. Although the interface system 515 is shown as being separate from the control system 510, in some implementations the interface system 515 may be part of the control system 510. In some implementations, the interface system 515 may include the entire control system 510. The control system 510 also may include (and/or be configured for communication with) one or more memory devices, such as one or more random access memory (RAM) devices, read-only memory (ROM) devices and/or other types of non-transitory media. In some implementations, at least a portion of the control system 510 may be implemented as a register. Accordingly, the apparatus 500 may have a memory system that includes one or more memory devices, though the memory system is not shown in FIG. 5.

The control system 510 may be capable of performing, at least in part, the methods disclosed herein. In some examples, the control system 510 may be capable of performing at least some of the methods described herein according to instructions (e.g., software) stored on non-transitory media. For example, the control system 510 may be configured for controlling the display system 505 and/or for receiving and processing data from at least a portion of the display system 505, e.g., as described below.

The display system 505 may include, one or more liquid crystal displays (LCDs), plasma displays, light-emitting diode (LED) displays, microLED displays or organic light-emitting diode (OLED) displays. According to some implementations, the display system 505 may include at least one flexible display, such as a flexible OLED. Although shown as separate components in FIG. 5, the display system 505 may, in some examples, include at least a portion of the control system 510. For example, the display system 505 may include one or more processors, microprocessors, programmable logic devices, discrete gates or transistor logic, etc.

In the example shown in FIG. 5, the apparatus 500 includes an interface system 515. In some examples, the interface system may include a wireless interface system. In some implementations, the interface system 515 may include a network interface, an interface between the control system 510 and the display system 505, an interface between the control system 510 and a memory system and/or an interface between the control system 510 and an external device interface (e.g., a port or an applications processor). In some examples, the interface system 515 may include one or more user interfaces, such as a touch screen, one or more buttons, a gesture recognition system, a voice recognition system, etc.

According to some implementations, the apparatus 500 may be a single device, whereas in other implementations the apparatus 500 may be a system that includes more than one device. Accordingly, the terms "apparatus" and "system" may sometimes be used interchangeably herein. In other examples, the apparatus 500 may be a component of another device. For example, in some implementations at least a portion of the display system 505 and/or the control system 510 may be included in more than one apparatus. For example, in some implementations at least part of the control system 510 may reside in a server, such as a central determination server, a server that tracks feature award credits, etc.

Figure 6:
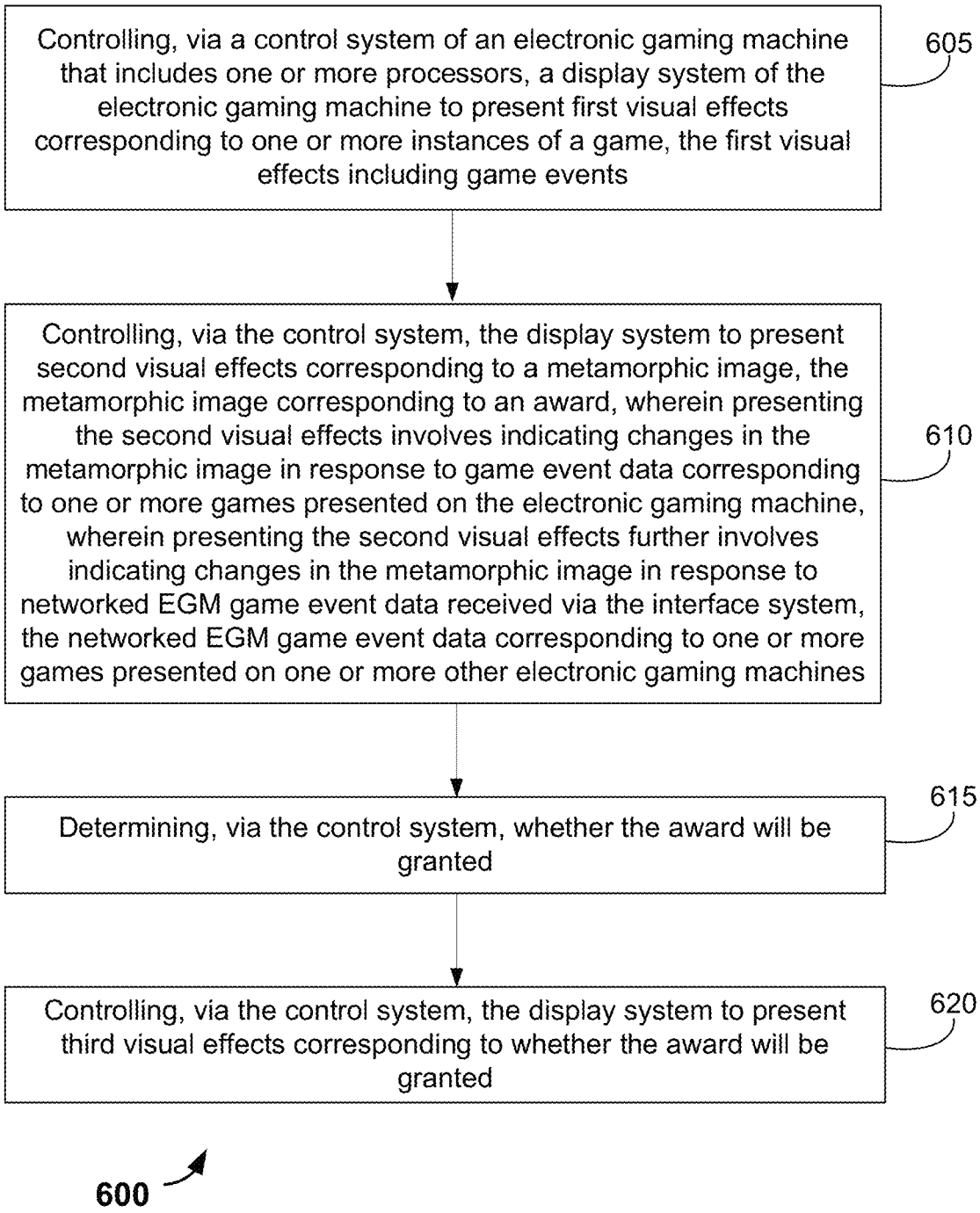
FIG. 6 is a flow diagram that shows blocks of a method according to one example.

FIG. 6 is a flow diagram that shows blocks of a method according to one example. In some examples method 600 may be performed, at least in part, by an apparatus such as that described above with reference to FIG. 5. In some examples, the method 600 may be performed by a control system (e.g., the control system 510 of FIG. 5) according to software stored upon one or more non-transitory storage media. As with other methods described herein, the number and sequence of blocks shown in FIG. 6 are merely examples. Similar disclosed methods may include more or fewer blocks. Moreover, at least some of the blocks may occur in a different sequence than the sequence that is shown in a flow diagram.

According to this example, block 605 involves controlling, via a control system of an electronic gaming device that includes one or more processors, a display system of the electronic gaming device to present first visual effects corresponding to one or more instances of a game. In some instances, the game may be a base game and in other instances the game may be a bonus game. The electronic gaming device may be referred to herein as the "local electronic gaming device." In some instances, the electronic gaming device may be referred to herein as the "local EGM." The game may vary according to the particular implementation. For example, the game may be a slot game, a video poker game, etc.

In this example the first visual effects including game events, which may correspond to one or more individual symbols of the game, one or more combinations of symbols of the game, both one or more individual symbols and one or more combinations of symbols of the game, etc. According to some examples, the game events may correspond to a "wild" symbol and/or one or more other symbols of the game. In some examples, a game event may involve the initiation of a process for obtaining a randomly-determined outcome that is triggered by an occurrence of a symbol or of a combination of symbols. According to one such example, the occurrence of a particular symbol may cause the control system to initiate the process of obtaining a randomly-determined outcome. The control system may initiate the process either by initiating a local process of obtaining the randomly-determined outcome (e.g., by initiating a random number generating algorithm) or by transmitting a request to another device (such as a server) for obtaining the randomly-determined outcome. In some implementations, the entire process from the occurrence of the symbol to obtaining the randomly-determined outcome may be considered a "game event."

In this example, block 610 involves controlling the display system to present second visual effects corresponding to a metamorphic image. Some examples of metamorphic images are described below with reference to FIGS. 7A-13B. Here, block 610 involves controlling the display system via the control system. According to this example, the metamorphic image corresponds to an award. The award may, for example, be (or may include) a credit award, such as a progressive jackpot award. However, in some examples the award may be, or may include, a fixed-credit award. In some examples, the award may be, or may include, a feature award. The feature award may include an award of one or more bonus games.

According to this implementation, presenting the second visual effects in block 610 involves indicating changes in the metamorphic image in response to game event data corresponding to one or more games presented on the electronic gaming device. The game event data may include data relating to any of the types of game events disclosed herein, including but not limited to the occurrence of one or more types of symbols during the game being presented by the electronic gaming device, a randomly-determined outcome that is obtained by the electronic gaming device upon the occurrence of one or more types of symbols during the game, etc. Such game events may be referred to herein as "local EGM game events" and the corresponding game event data may be referred to herein as "local EGM game event data."

However, in this example, presenting the second visual effects also involves indicating changes in the metamorphic image in response to networked EGM game event data received via the interface system. The networked EGM game event data may correspond to one or more games presented on one or more other electronic gaming devices, which may be referred to herein as networked electronic gaming devices. In some instances, the networked electronic gaming devices may be networked EGMs. In this example, the networked gaming devices are configured for communication with the local gaming device (either directly or indirectly) via a network, such as a casino gaming network, and interface systems of the local gaming device and the networked gaming devices. The networked gaming device game event data may include data relating to any of the types of game events disclosed herein, including but not limited to data relating to the occurrence of one or more types of symbols during the game being presented by a networked gaming device, a randomly-determined outcome that is obtained by a networked gaming device upon the occurrence of one or more types of symbols during the game, etc. Such game events may be referred to herein as "networked gaming device game events."

Accordingly, in some examples the metamorphic image may correspond to a number of game events that have occurred since an award has been granted. The game events may include local gaming device game events and networked gaming device game events.

In some instances, at least some of the networked gaming devices may be in the same group, or bank, as the local gaming device. However, according to some examples, at least some of the networked gaming devices may be in one or more other locations within a casino. In some examples, at least some of the networked gaming devices may be one or more locations outside the casino.

In some implementations, method 600 may involve a local gaming device and networked gaming devices, at least one of which may not be a casino-based gaming device. According to some such implementations, at least one of the gaming devices (local and/or networked) may be located outside of a casino. In some implementations, the local gaming device and the networked gaming devices may all be located outside of a casino.

According to this example, block 615 involves determining, via the control system, whether the award will be granted. In some instances, block 615 may involve determining whether the award will be granted via the local gaming device, e.g., to a person playing the local gaming device. However, in other instances, block 615 may involve determining whether the award will be granted via a networked gaming device, e.g., to a person playing one of the networked gaming devices. Accordingly, block 615 may involve determining that an award will be granted because of a local gaming device game event or because of a networked gaming device game event.

According to some examples, the occurrence of a particular symbol during the presentation of a game on the local gaming device or a networked gaming device may cause a control system of the local gaming device or a networked gaming device to initiate the process of obtaining a randomly-determined outcome. The control system may initiate the process either by initiating a local process of obtaining the randomly-determined outcome (e.g., by initiating a random number generating algorithm) or by transmitting a request to another device (such as a server) for obtaining the randomly-determined outcome. In some such implementations, the award may be a progressive award and the control system may obtain the randomly-determined outcome from a progressive server. According to some implementations, block 615 may involve receiving, at a local gaming device and via an interface system, networked game event data indicating that an award will be granted via a networked gaming device.

According to this example, block 620 involves controlling, via the control system, the display system to present third visual effects corresponding to whether the award will be granted. For example, if it is determined in block 615 that a credit award will be granted via the local gaming device, block 620 may involve updating a credit meter of the local gaming device to indicate the credit award. In some such examples, if it is determined in block 615 that a credit award will be granted via the local gaming device, block 620 may involve presenting images corresponding to a celebration of the award, such as a congratulatory message, a display of showering coins, etc.

However, if it is determined in block 615 that a credit award will be granted via a networked gaming device, block 620 may involve updating another meter of the local gaming device, such as a progressive meter, to indicate the credit award. According to some such examples, block 620 may involve re-setting a progressive meter to indicate that the progressive has been awarded. In some examples, a control system of the local gaming device may cause the display system and/or an audio system to present an indication that an award will be granted via a networked gaming device (e.g., "Someone else won this award!").

According to some examples, if it is determined in block 615 that a credit award will not be granted via the local gaming device, block 620 may involve presenting a different type of visual effects. The type of visual effects may depend on the particular implementation. In some examples described below, if it is determined in block 615 that a credit award will not be granted via the local gaming device, block 620 may involve presenting a response to a particular symbol, or combination of symbols, that indicates an unsuccessful outcome, or of a partially successful outcome. In some such instances, block 620 may involve presenting an indication that the state of the metamorphic image will change, but that no award will be granted. This may be referred to herein as a partially successful outcome. In other examples, block 620 may involve presenting an indication that the state of the metamorphic image will not change and that no award will be granted. This may be referred to herein as an unsuccessful outcome.

As used herein, the "state" of the metamorphic image includes visual characteristics of the metamorphic image at a particular time. As the metamorphic image changes, its state changes. The state changes depend on the particular type of metamorphic image and the particular implementation. For example, if the metamorphic image includes a string of firecrackers, the state of the metamorphic image may be indicated, at least in part, by how many firecrackers in the string of firecrackers currently have lit fuses. If changes to the metamorphic image include a change in size and/or shape of the metamorphic image, the state of the metamorphic image may correspond, at least in part, to the current size and/or shape of the metamorphic image. If the metamorphic image includes a sector of a circle, the state of the metamorphic image may correspond, at least in part, to the current size of the sector.

Depending on the particular implementation, a state of the metamorphic image may or may not correspond to a probability of an award being granted. As noted above, in some examples the metamorphic image may change in response to a randomly-determined outcome that is obtained upon the occurrence of one or more types of symbols during a game. In some such examples, the state of the metamorphic image may seem to correspond to a probability of an award being granted, but it will not.

FIGS. 7A-11B show examples of game displays that include metamorphic images. According to the example shown in FIG. 7A, a control system is controlling a display system of a gaming device to display an image 700*a* corresponding to an instance of a game. Here, the game is a slot game. In this example, a player may interact with a gaming device that is presenting the game (which may be an EGM, a mobile gaming device or another type of device, depending on the particular implementation) via user input areas, which include the spin button 715 and the max bet button 720. The credit meter 725*a* indicates a player's remaining credits. The win meter 730*a* indicates the current win amount, if any.

In this example, the image 700*a* includes metamorphic images 705*a*-705*d*, each of which is associated with a corresponding one of the progressive meters 710*a*-710*d*: the metamorphic image 705*a* is associated with the progressive meter 710*a*, the metamorphic image 705*b* is associated with the progressive meter 710*b*, the metamorphic image 705*c* is associated with the progressive meter 710*c* and the metamorphic image 705*d* is associated with the progressive meter 710*d*.

According to this example, each of the metamorphic images 705*a*-705*d* is a string of firecrackers. Other implementations may involve other types of progressive images, including but not limited to the specific types disclosed herein.

In this example, each string of firecrackers is slightly different in appearance from the other firecracker strings. For example, metamorphic images 705*a* and 705*b* include firecrackers on only one side of the main fuse, whereas metamorphic images 705*c* and 705*d* include firecrackers on both sides of the main fuse. Moreover, each metamorphic image includes different sizes of firecrackers, with those of metamorphic image 705*a* being the largest. The relative size of the firecrackers is related to the size of the award that may be won via the associated progressive.

Figure 7A:
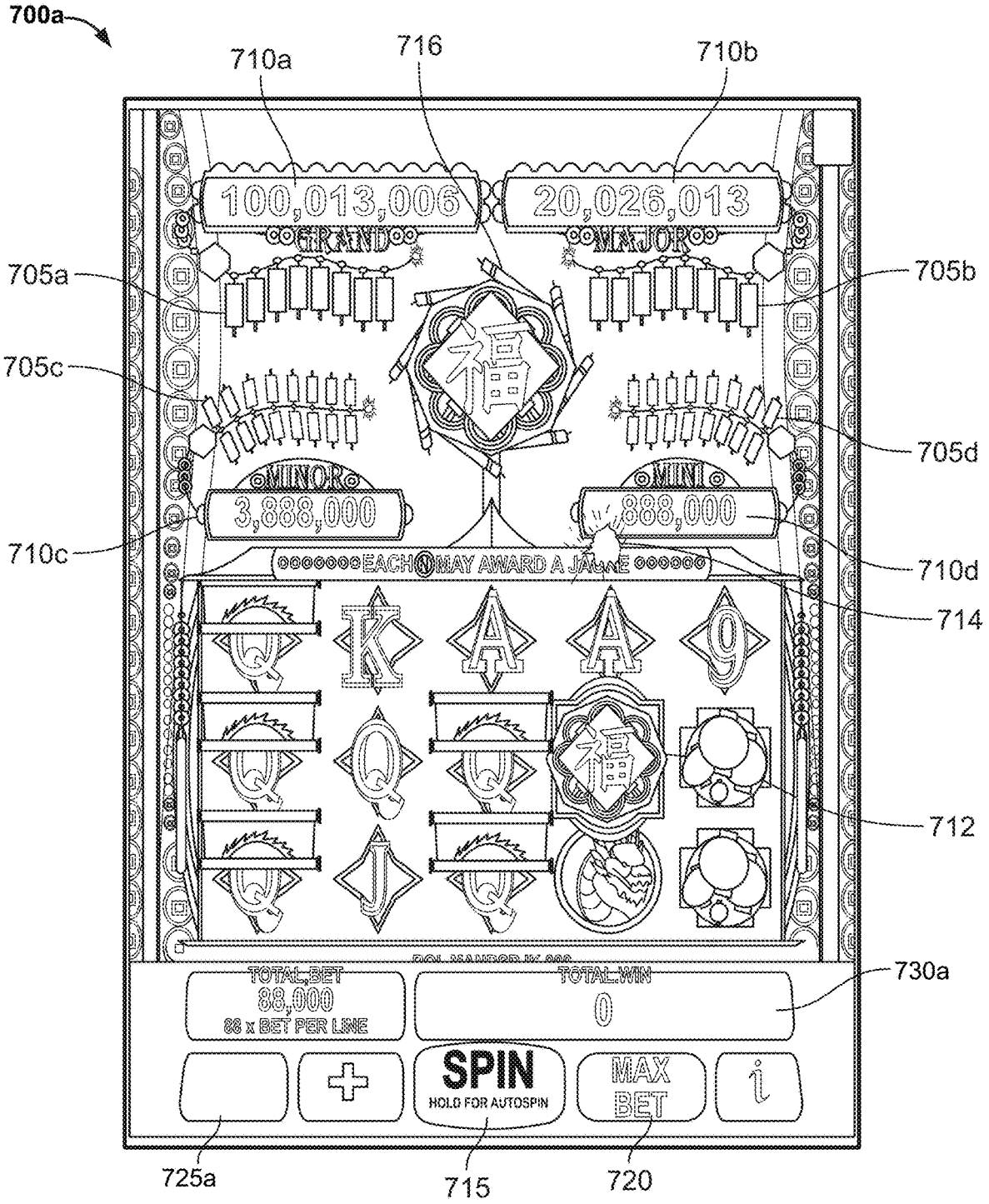
FIGS. 7A-11B show examples of game displays that include metamorphic images.

In the example shown in FIG. 7A, the state of the metamorphic images 705*a*-705*d* may be indicated, at least in part, by how many firecrackers in the string of firecrackers currently have lit fuses. In this instance, none of the individual firecrackers of the metamorphic images 705*a*-705*d* are currently lit.

This implementation is an example in which the metamorphic image may change in response to a randomly-determined outcome that is obtained upon the occurrence of one or more types of symbols during a game. According to this implementation, the state of a metamorphic image may potentially be changed by the occurrence of a particular symbol, which is the wild symbol 712 in this example. At the time depicted by the image 700*a*, the control system is causing the display system to depict an image of a spark 714, which in this example has emanated from the wild symbol 712 and is moving towards the fireworks wheel 716.

Figure 8A:
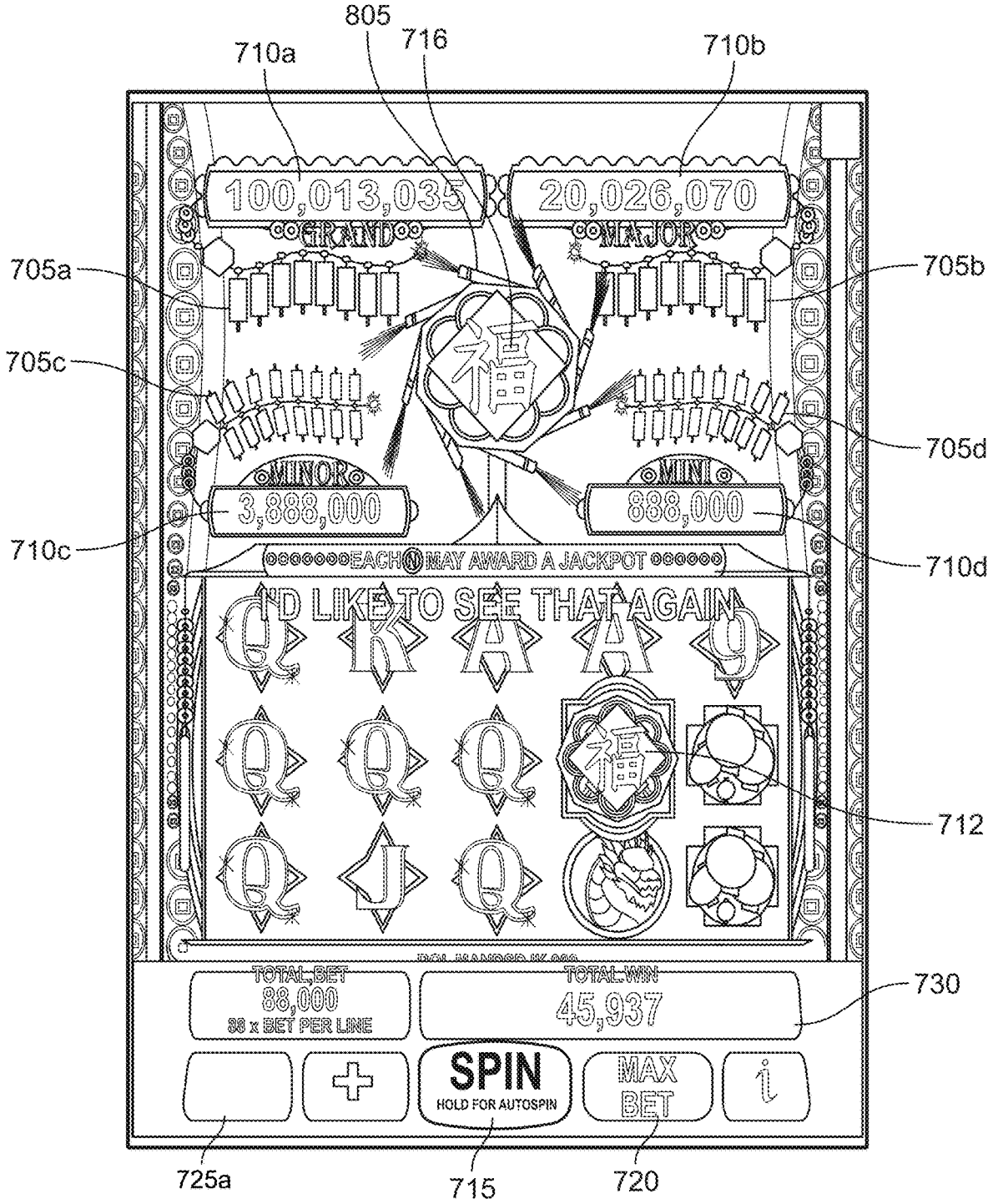

FIG. 8A shows an example of a game display at a time after that depicted in FIG. 7A. In this example, the spark 714 from the wild symbol 712 has reached the fireworks wheel 716, rockets 805 of which are now shown as being ignited. In some implementations, the control system may cause the display system to depict the fireworks wheel 716 as if it were rotating clockwise, in the direction suggested by the ignited rockets 805. According to some such implementations, depicting the rockets 805 as being ignited is an indication that a randomly-determined outcome, the initiation of which was triggered by the occurrence of the wild symbol 712, will result in changing the state of at least one of the metamorphic images 705*a*-705*d*. In some such implementations, depicting the rockets 805 as being ignited is an indication that either a partially successful outcome (e.g., the lighting of a firecracker of one of the metamorphic images 705*a*-705*d*) or a successful outcome (e.g., the granting of an award) will soon be indicated on the display. At this point in time, however, a player does not yet know which of these outcomes will follow. Accordingly, the player's excitement may be building as the player waits to determine which outcome will be presented.

According to some such implementations, if the randomly-determined outcome was an unsuccessful outcome, the rockets 805 of the fireworks wheel 716 are not shown as being ignited by the spark 714. In some such examples, the fireworks wheel 716 may nonetheless be depicted to move, at least slightly, after the spark 714 comes near the fireworks wheel 716. For example, the fireworks wheel 716 may nonetheless be depicted to twitch after the spark 714 comes near the fireworks wheel 716, as if the rockets 805 of the fireworks wheel 716 may possibly ignite. Accordingly, the player's excitement may be enhanced, at least for a moment, because the player may still believe that the player will win an award or that a firecracker may be lit.

Figure 9A:
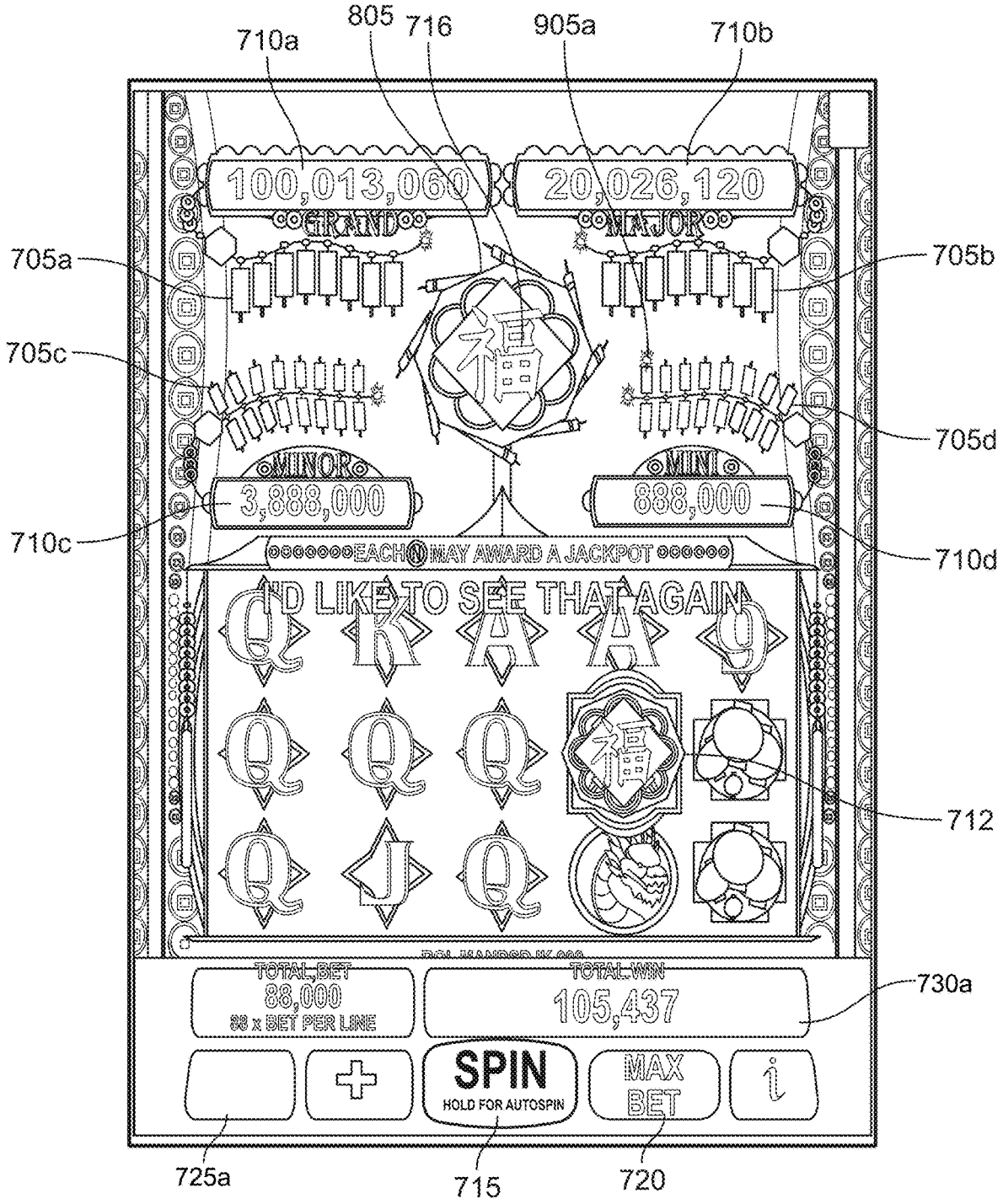

FIG. 9A shows an example of a game display at a time after that depicted in FIG. 8A. In this example, the firecracker 905*a* of the metamorphic image 705*d* is shown as being lit. Accordingly, the state of the metamorphic image 705*d* has been changed, as compared to the state shown in FIGS. 7A and 8A. In this example, a randomly-determined outcome, the initiation of which was triggered by the occurrence of the wild symbol 712, was a partially successful outcome.

Figure 9B:
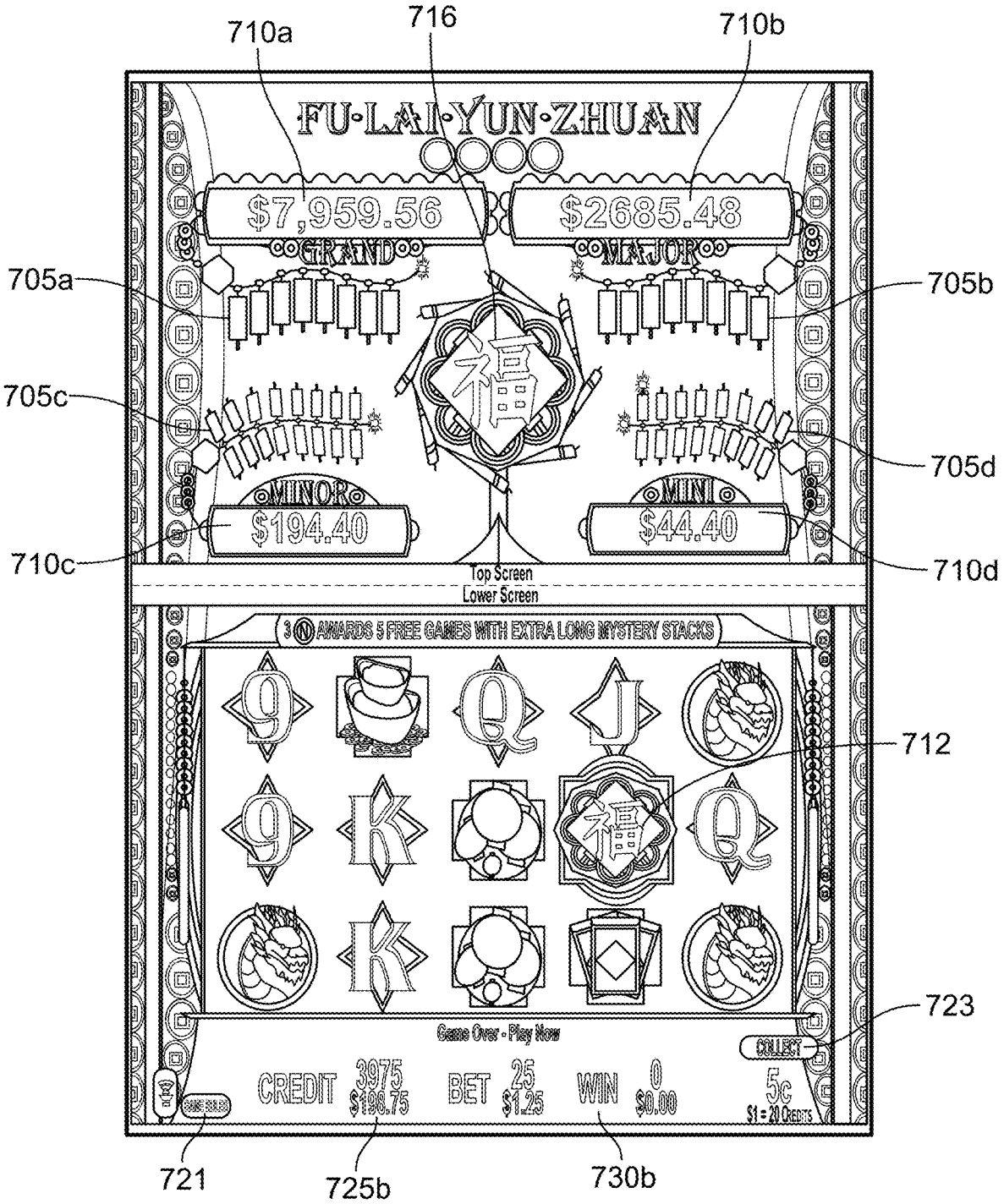
Figure 10A:
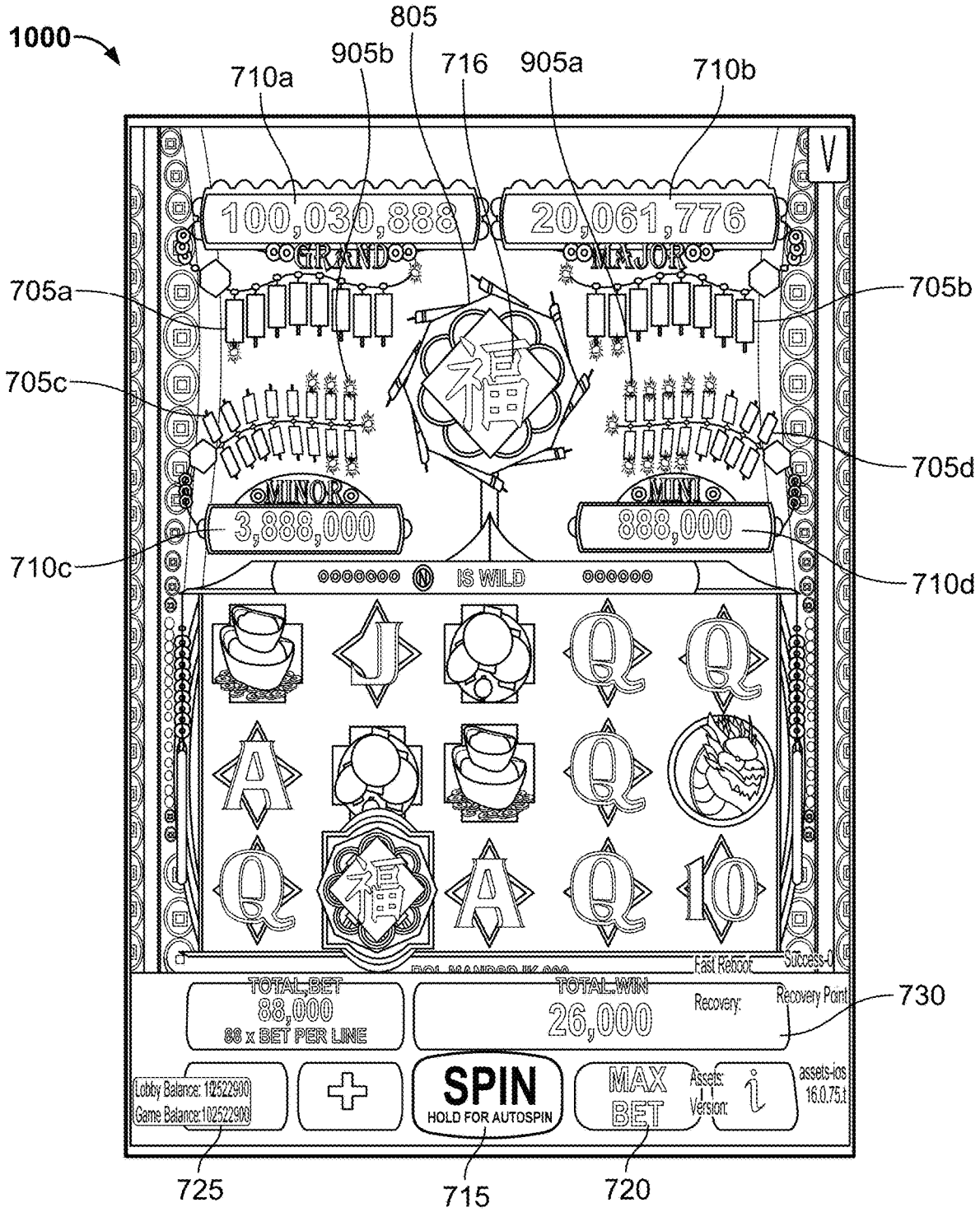

FIG. 10A shows an example of a game display at a time after that depicted in FIG. 9A. In this example, the firecracker 905*a* and eight additional firecrackers of the metamorphic image 705*d* are shown as being lit. In addition, the firecracker 905*b* of the metamorphic image 705*c* is shown as being lit. Accordingly, the states of the metamorphic images 705*c* and 705*d* have been changed, as compared to the states shown in FIGS. 7A-9A.

In some implementations, the state of at least one of the metamorphic images 705*a*-705*d* may be changed in response to networked gaming device game event data. For example, one or more of the firecrackers that are shown to be lit in FIG. 10A may correspond with a randomly-determined partially successful outcome, the initiation of which was triggered by the occurrence of a wild symbol 712 on a networked gaming device. The local gaming device may have received networked game event data indicating one or more partially successful outcomes corresponding to game presentations on one or more networked gaming devices, and a control system of the local gaming device may have caused the display system to update the state of the metamorphic image(s) accordingly. According to some such implementations, the networked game event data may indicate which metamorphic image(s) to update and how to update the metamorphic image(s).

At the time depicted in FIG. 10A, the majority of the firecrackers of the metamorphic image 705*d* are shown as being lit. At this time, five of the firecrackers of the metamorphic image 705*c*, two of the firecrackers of the metamorphic image 705*b* and one of the firecrackers of the metamorphic image 705*a* are shown as being lit. It may appear to a player that the probability of being awarded the associated progressive awards (e.g., the award that corresponds to the progressive meter 710*d*) has increased, as compared to times during which fewer of the firecrackers of the metamorphic images (e.g., the metamorphic image 705*d*) were lit. However, in this example, the state of a metamorphic image has no correlation to a probability of an award being granted.

According to some alternative implementations, the state of a metamorphic image may actually indicate a probability of an award being granted. According to some such implementations, the state of the metamorphic image 705*d* shown in FIG. 10A may actually indicate an increased probability of an award being granted, as compared to the probability corresponding to the state of the metamorphic image 705*d* shown in FIG. 7A or FIG. 9A. Similarly, the state of the metamorphic image 705*c* shown in FIG. 10A may actually indicate an increased probability of an award being granted, as compared to the probability corresponding to the state of the metamorphic image 705*c* shown in FIG. 7A or FIG. 9A. In some such examples, the state of the metamorphic image may change in response to the occurrence of one or more symbols, or a combination of one or more symbols, during the presentation of a game on a local gaming device or a networked gaming device.

Figure 11A:
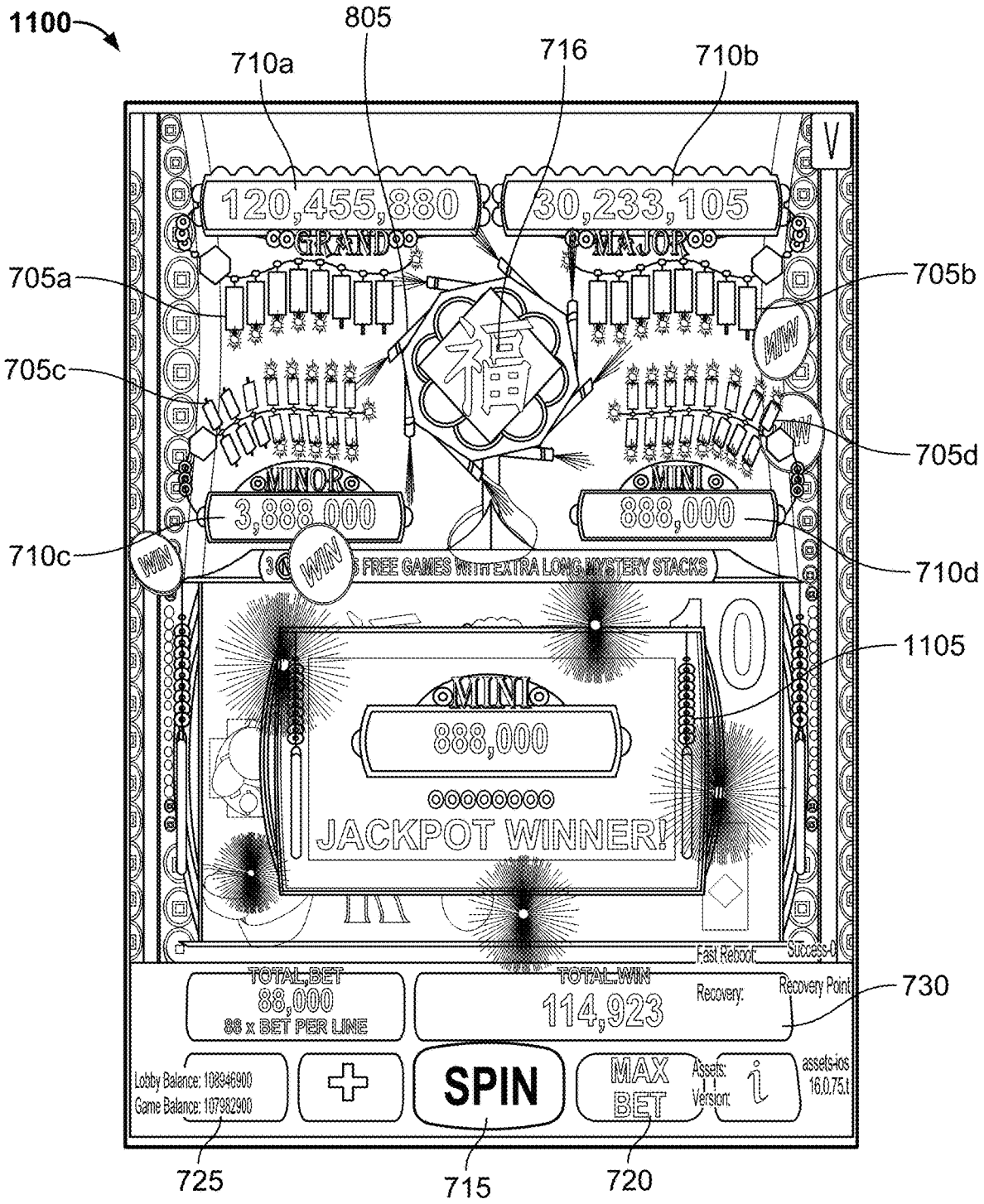

FIG. 11A shows an image that is part of a celebration display according to one example. In this example, a randomly-determined outcome, the initiation of which was triggered by the occurrence of a wild symbol, was a successful outcome and the image 1100*a* corresponds with a celebration of the successful outcome. In this example, the successful outcome involves the award of a "mini" jackpot that is associated with the metamorphic image 705*d*. Accordingly, the state of the metamorphic image 705*d* is now one in which all of its firecrackers are shown as being lit. Prior to the time of the events depicted by FIG. 11A, in this instance a spark was depicted as flying from a wild symbol to the fireworks wheel 716, the rockets 805 of which are still shown as being ignited. In this example, the control system is controlling the display system to present a celebration display in area 1105, which includes depictions of fireworks, text indicating an award of the mini jackpot and the amount of the mini jackpot, which corresponds to the amount indicated on the progressive meter 710*d*.

Although some of the details, such as the particular slot symbol arrangements, are not identical, the game display examples that are shown in FIGS. 7B-11B are similar to those shown in FIGS. 7A-11A. The game display examples that are shown in FIGS. 7A-11A may be relatively more suitable for online gaming, whereas the game display examples that are shown in FIGS. 7B-11B may be relatively more suitable for wager-based gaming, e.g., for presentation on casino-based gaming devices.

Figure 7B:
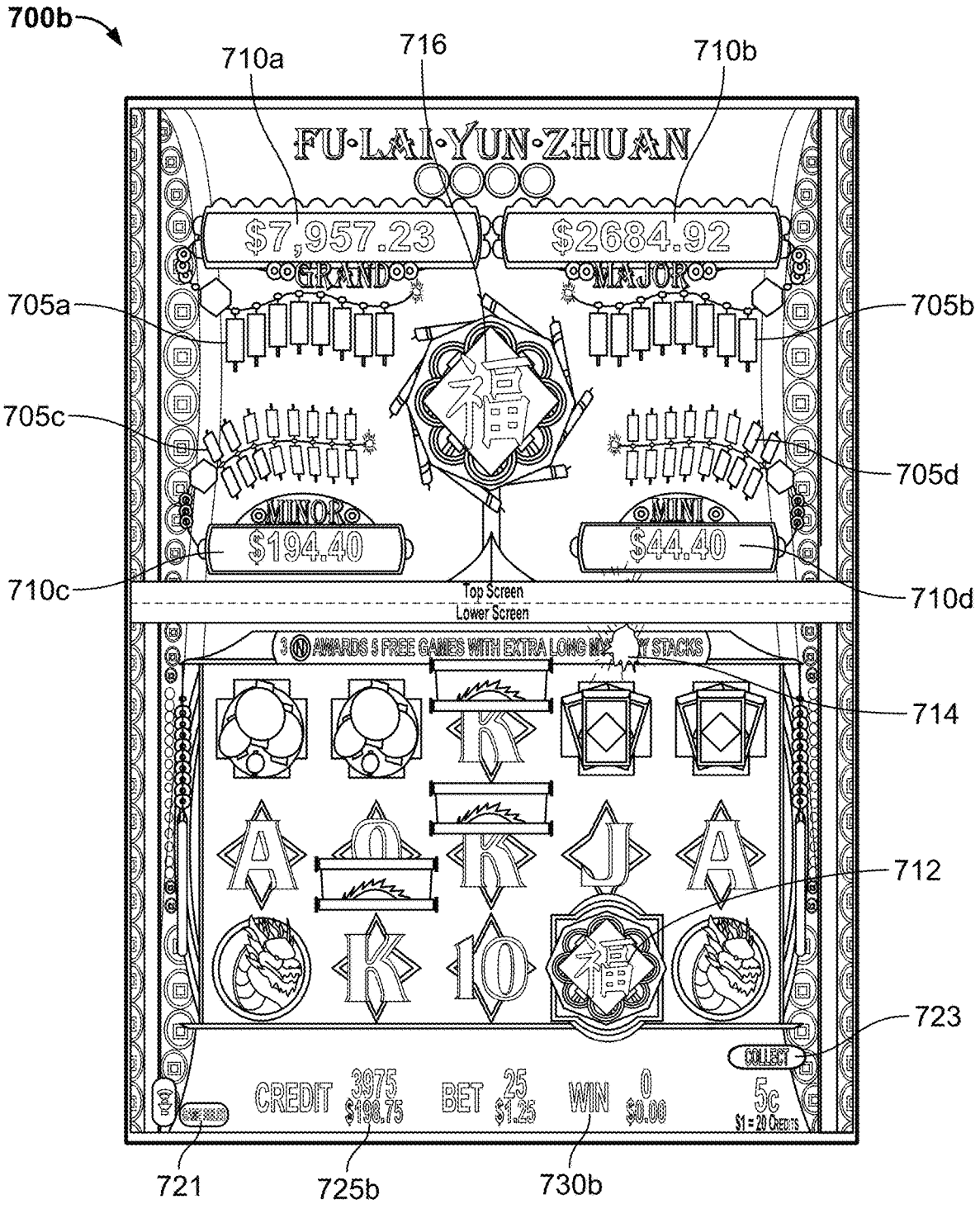

In the example shown in FIG. 7B, a control system is controlling a display system of a gaming device to display an image 700*b* corresponding to an instance of a game. The gaming device may, for example, be an EGM, or a casino-based mobile gaming device. In this example, the image 700*b* corresponds in many respects to the image 700*a*. For example, the image 700*b* includes metamorphic images 705*a*-705*d*, each of which is associated with a corresponding one of the progressive meters 710*a*-710*d*. At the time depicted by the image 700*b*, the control system is causing the display system to depict an image of a spark 714, which in this example has emanated from the wild symbol 712 and is moving towards the fireworks wheel 716. A player may interact with a gaming device that is presenting the game via user input areas, which include the game rules button 721 and the cash out button 723. The credit meter 725*b* indicates a player's remaining credits. The win meter 730*b* indicates the current win amount, if any.

Figure 8B:
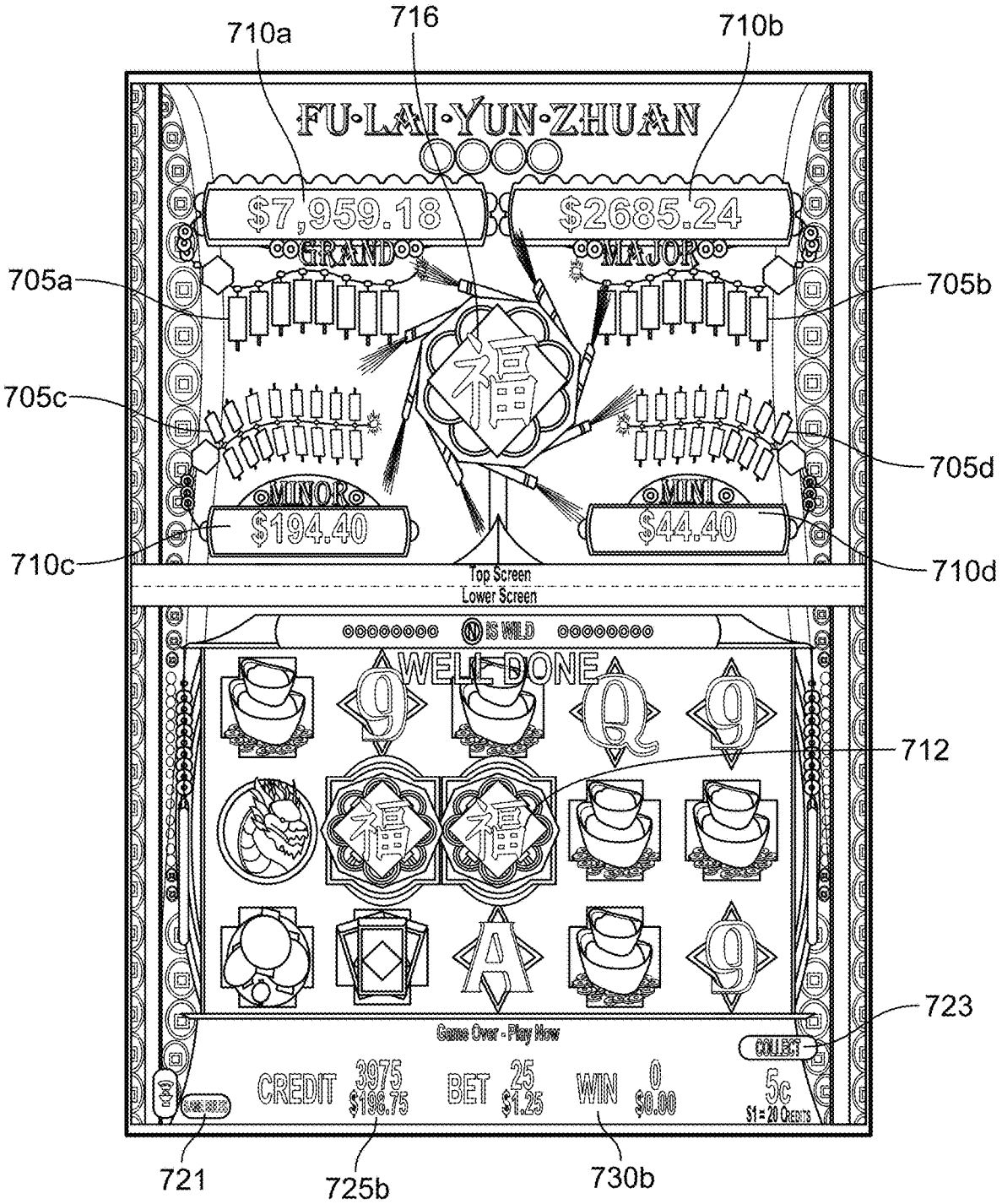

FIG. 8B shows an example of a game display at a time after that depicted in FIG. 7B. In this example, a spark 714 from the wild symbol 712 has reached the fireworks wheel 716, rockets 805 of which are now shown as being ignited.

FIG. 9B shows an example of a game display at a time after that depicted in FIG. 8B. In this example, the state of the metamorphic images 705*c* and 705*d* have been changed, as compared to the state shown in FIGS. 7B and 8B: one firecracker in each of the metamorphic images has been lit at the time depicted in FIG. 9B.

Figure 10B:
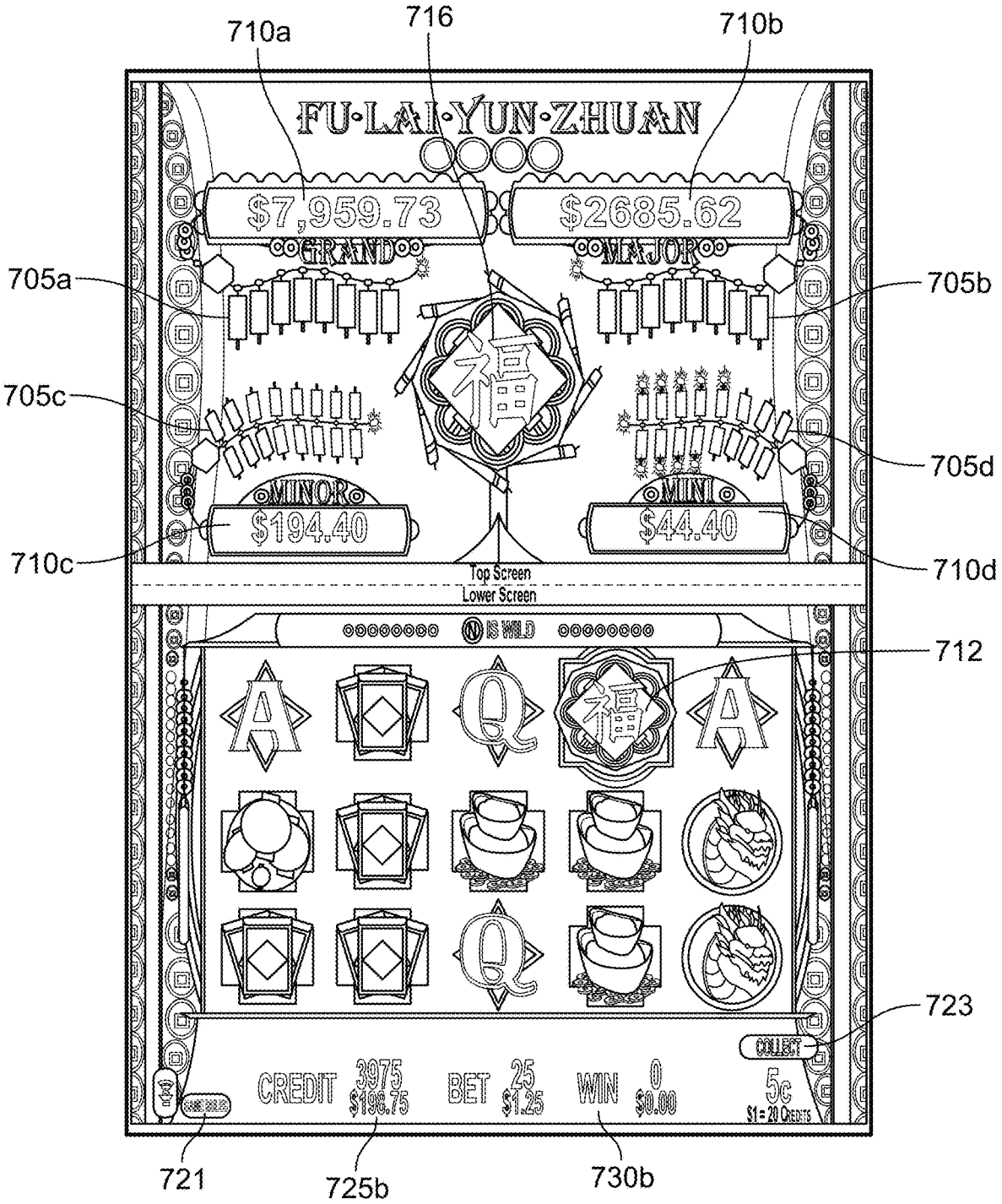
Figure 11B:
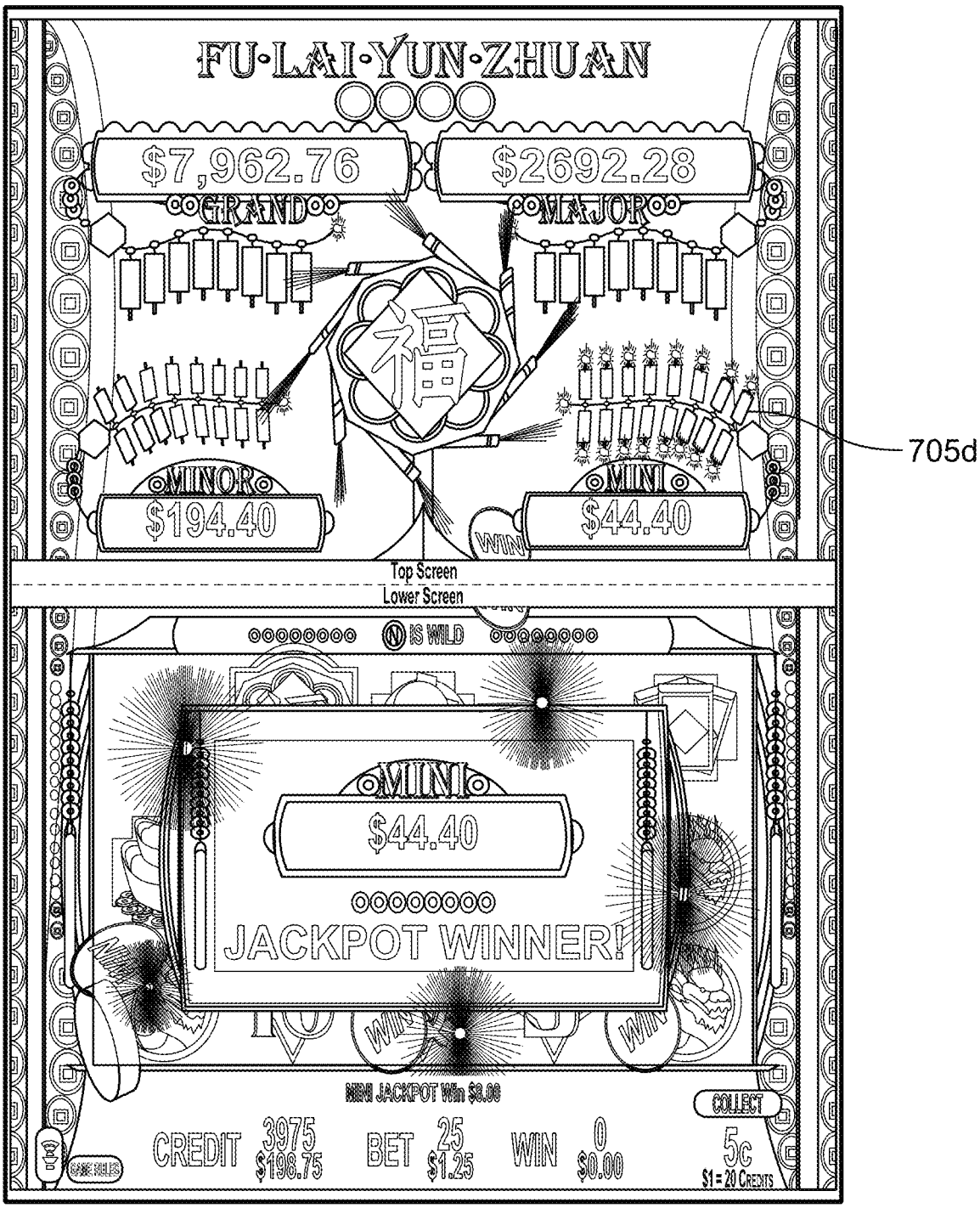

FIG. 10B shows an example of a game display at a time after that depicted in FIG. 9B. In this example, eight additional firecrackers of the metamorphic image 705*d* are shown as being lit. Accordingly, the state of the metamorphic image 705*d* has been changed, as compared to the states shown in FIGS. 7B-9B. FIG. 11B shows an image that is part of a celebration display that is presented after all firecrackers of the metamorphic image 705*d* have been lit.

What may be referred to herein as "collection-based" games are popular with some players. Some collection-based games may be wagering games. Collection-based games generally involve accumulating one or more types of game play items, such as one or more types of symbols, while playing a game in order to trigger a "feature." The feature may include a bonus game or a bonus round. The game may be base game or a bonus game. In general, a player may need to play many instances of a base game in order to accumulate enough game play items to trigger an automatic award of the feature. For example, a player may need to accumulate a predetermined number of scatter symbols (e.g., 6 scatter symbols) to trigger an automatic award of the feature.

In some implementations, a player may be able to accumulate "feature award credits" by collecting game play items during play of a base game.

According to some examples, the award that is referenced elsewhere herein (e.g., in the discussion of FIG. 6 and/or one of its permutations) may be, or may include, a feature award. The feature award may include an award of one or more bonus games. In some such instances, the state of the metamorphic image may correspond to an accumulation of feature award credits towards an automatic feature award. In some such examples, the "first visual effects" of block 605 may include game play items that correspond to the feature award credits.

According to some implementations, the state of the metamorphic image may change (e.g., in block 610 of FIG. 6) in response to local gaming device feature award credits that correspond to local gaming device game events. However, in some such implementations the state of the metamorphic image also may change (e.g., in block 610 of FIG. 6) in response to networked gaming device feature award credits that correspond to networked gaming device game events.

Method 600 may, in some examples, involve determining instances, or occurrences, of a particular type of symbol that corresponds with one or more feature award credits. In some such examples, the occurrence of one symbol will correspond with one feature award credit. However, in alternative examples the occurrence of one symbol may correspond with multiple feature award credits, or less than one feature award credit. In some instances, the occurrence of a first type of symbol may correspond with X feature award credits and the occurrence of a second type of symbol may correspond with Y feature award credits. For example, a wild symbol may correspond with 1, 2 or 3 feature award credits and a scatter symbol may correspond with 5 or 10 feature award credits.

According to some examples, even if the player has not accumulated enough feature award credits to trigger an automatic award of a feature, the player will have the chance to try his or her luck at triggering the feature. In some such examples, the player may be the player that is using the local gaming device or a player that is using any one of the networked gaming devices. In some examples, an attempt to trigger an award of the feature may be made in exchange for an additional wager. For example, a control system of an gaming device may be configured for controlling the display system to display a prompt indicating that an attempt to trigger an award of the feature may be made in exchange for an additional wager. In some examples, an attempt to trigger an award of the feature may be made in exchange for a player's remaining credit balance, at a time during which the remaining credit balance is insufficient for playing another instance of a base game.

For example, suppose that 100 feature award credits must be accumulated in order to trigger an automatic award of a feature. Before all 100 feature award credits have been accumulated, a player may choose to try his or her luck and attempt triggering the feature. In some examples, the player's chance of triggering the feature may correspond with the number of accumulated feature award credits, relative to the number of feature award credits required to trigger an automatic award of a feature. According to some such examples, if 100 feature award credits are required to trigger an automatic award of a feature but only N feature award credits have been accumulated (where N is less than 100 in this example), the chance of triggering the feature would be N/100.

In some examples, a player might choose to attempt triggering the feature because the player is running out of money. However, in other instances a player might decide to attempt triggering the feature because the player believes that he or she has a good enough chance to try. For example, if 75% of the required feature award credits, 80% of the required feature award credits, etc., have been accumulated, a player may believe that this is close enough to attempt triggering the feature.

Each player, including the player that is using the local gaming device and the players of the networked gaming devices, should realize that any one of the players may attempt to trigger the feature at any time. This may increase the suspense and excitement of all players, and may encourage competition between the players. For example, competition may induce any one of the players to try and trigger the feature before he or she believes that enough feature award credits to justify an attempt triggering the feature have been accumulated, because that player may believe that another player may soon decide to try his or her luck at triggering the feature.

In some instances, method 600 may involve receiving an indication, via the interface system, of a player's initiation of an attempt to trigger a grant of the feature award. According to some examples, the indication may be received at a time during which less than a number of feature award credits necessary for an automatic grant of the feature award has been accumulated. The indication may correspond to user input to the local gaming device or user input to one of the networked gaming devices. According to some such implementations, block 615 of FIG. 6 may involve determining whether the feature award will be granted. Some such examples may involve controlling the display system to present visual effects corresponding to whether a feature award has been granted. If it is determined that a feature award has been granted, such implementations may involve controlling an gaming device display system (e.g., the display system of the local gaming device) to present visual effects corresponding to the feature award. For example, gaming device display system may be controlled to present visual effects corresponding to one or more bonus games.

FIGS. 12A-13D show examples of feature award credit meters. As with other figures provided herein, the specific details of FIGS. 12A-13D are merely shown by way of example. The feature award credit meters 1200 of FIGS. 12A-13D are examples of the "second visual effects corresponding to an accumulation of feature award credits towards the automatic award of the feature" noted in block 615 of FIG. 6. Accordingly, in these examples the feature award credit meters 1200 are graphical representations of accumulated feature award credits. A control system of a device, such as an EGM, a mobile gaming device or an EUD, may control at least a portion of a display system to present such graphical representations of feature award credit meters, or alternative graphical representations of feature award credit meters.

In the examples shown in FIGS. 12A-12D, the feature award credit meters 1200 are configured such that the second visual effects comprise a sector 1205 of a circle. In these examples, the area of the sector 1205 corresponds to a percentage of feature award credits necessary for an automatic award of the feature. Accordingly, in these examples the arc corresponding with the sector 1205 and the angle corresponding with the sector 1205 also correspond to a percentage of feature award credits necessary for an automatic award of the feature. The area of the sector 1205 may or may not correspond to a player's chance of being awarded the feature, if the player attempts to trigger an award of the feature at a time during which less than a number of feature award credits necessary for an automatic award of the feature has been accumulated, depending on the particular implementation.

In the example shown in FIG. 12A, the feature award credit meter 1200 is shown at a time during which the sector 1205 occupies approximately 20% of the circle, indicating that approximately 20% of the feature award credits necessary for an automatic award of the feature have been accumulated at this time. According to this example, the sector 1205 is shown to be enlarged in the direction of the arrow 1203 as additional feature award credits are accumulated. By the time depicted in FIG. 12B, the sector 1205 occupies approximately 70% of the circle, indicating that approximately 70% of the feature award credits necessary for an automatic award of the feature have been accumulated.

In some implementations, the color of the sector 1205 may change, e.g., from colder colors to hotter colors as the size of the sector 1205 increases. For example, the color of the sector 1205 may be blue if only a small percentage of the feature award credits necessary for an automatic award of the feature has been accumulated and may be red if nearly all of the feature award credits necessary for an automatic award of the feature have been accumulated. According to some implementations, the color of the sector 1205 may be blue if less than 20% of the necessary feature award credits have been accumulated, green if from 20% to less than 40% of the necessary feature award credits have been accumulated, yellow if from 40% to less than 60% of the necessary feature award credits have been accumulated, orange if from 60% to less than 80% of the necessary feature award credits have been accumulated, and red if 80% or more of the necessary feature award credits have been accumulated. The reader will appreciate that these specific colors and percentage ranges are merely made by way of example; alternative examples may progress through more or fewer color ranges and may change colors at different intervals, or may change colors gradually as each additional feature award credit is shown. Alternatively, or additionally, the overall size of the feature award credit meter may change (e.g., may increase) as additional feature award credits are accumulated. Changing the color and/or the size of the feature award credit meter may add to player excitement.

FIG. 12A also shows an example of a virtual button 1210, with which a player can interact to provide an indication, via an interface system of an apparatus, of a player's initiation of an attempt to trigger an award of the feature. Accordingly, a player may interact with the virtual button 1210 in order to provide one example of an indication that is described above with reference to block 620 of FIG. 6. The area of the virtual button 1210 may, for example, correspond with an area of a display in which at least a portion of a sensor system is disposed. The sensor system, which may be regarded as part of an interface system (such as the interface system 515 that is described above with reference to FIG. 5) may be configured for touch and/or gesture detection. Accordingly, in this example the "second visual effects" include an area within a circle, which corresponds with an area of the virtual button 1210 in this instance. According to this example, the indication of the player's initiation of an attempt to trigger an award of the feature includes receiving an indication of a player's touch or gesture in a portion of the sensor system that corresponds with the area within the circle.

Although in FIGS. 12A-12D the virtual button 1210 is shown within the feature award credit meters 1200, in alternative implementations the virtual button 1210 may be shown outside an area occupied by the feature award credit meter 1200, or outside an area occupied by another type of feature award credit meter 1200.

FIGS. 12C and 12D provide examples of visual effects that may be presented after receiving an indication of a player's initiation of an attempt to trigger an award of a feature. In some examples, these visual effects (or similar visual effects) may be presented after determining whether an award of the feature will be triggered. Accordingly, these graphical representations are examples of "controlling, via the control system, the display system to present third visual effects corresponding to whether the award will be granted," as stated in block 620 of FIG. 6.

In the example shown in FIG. 12C, presenting the "third visual effects" involves controlling a display to cause a representation of the pointer 1215 to rotate around the representation of the feature award credit meter 1200. If it is determined (e.g., in block 625 of method 600, shown in FIG. 6) that an award of the feature will be triggered, in this example the pointer 1215 will stop somewhere within the sector 1205. In this example, if it is determined that an award of the feature will not be triggered, the pointer 1215 will stop somewhere outside of the sector 1205.

According to the example shown in FIG. 12D, presenting the "third visual effects" involves controlling a display to cause a representation of the sector 1205 to rotate around the representation of the feature award credit meter 1200. If it is determined that an award of the feature will be triggered, in this example the sector 1205 will stop in a position such that pointer 1215 is at a position within the sector 1205. In this example, if it is determined that an award of the feature will not be triggered, the sector 1205 will stop in a position such that pointer 1215 is somewhere outside of the sector 1205.

FIGS. 13A-13D show alternative examples of feature award credit meters. In these examples, the second visual effects include a bar 1220. According to these examples, the size of the bar 1220, (e.g., an area of the bar 1220) corresponds to a percentage of feature award credits necessary for an automatic award of the feature.

In the example shown in FIG. 13A, the feature award credit meter 1200 is shown at a time during which area of the bar 1220 occupies approximately 40% of the area of the feature award credit meter 1200, indicating that approximately 40% of the feature award credits necessary for an automatic award of the feature have been accumulated at this time. According to this example, the bar 1220 is shown to be enlarged in the direction of the arrow 1225 as additional feature award credits are accumulated. By the time depicted in FIG. 13B, the bar 1220 occupies approximately 60% of the area of the feature award credit meter 1200, indicating that approximately 60% of the feature award credits necessary for an automatic award of the feature have been accumulated.

Figure 13C:
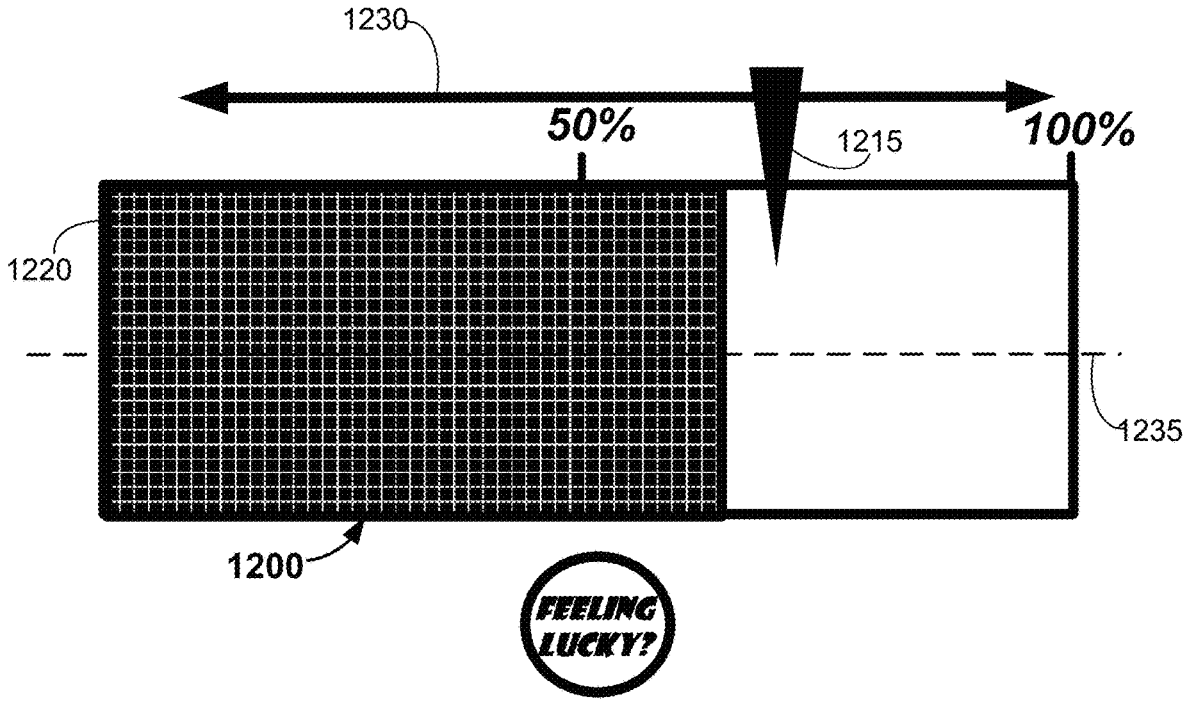

In the example shown in FIG. 13C, presenting the "third visual effects" involves causing a representation of the pointer 1215 to slide back and forth along a line represented by the arrow 1230, which in this example is parallel to the long axis 1235 of the feature award credit meter 1200. If it is determined that an award of the feature will be triggered, in this example the pointer 1215 will stop somewhere within the bar 1220. In this example, if it is determined that an award of the feature will not be triggered, the pointer 1215 will stop somewhere outside of the bar 1220.

Figure 13D:
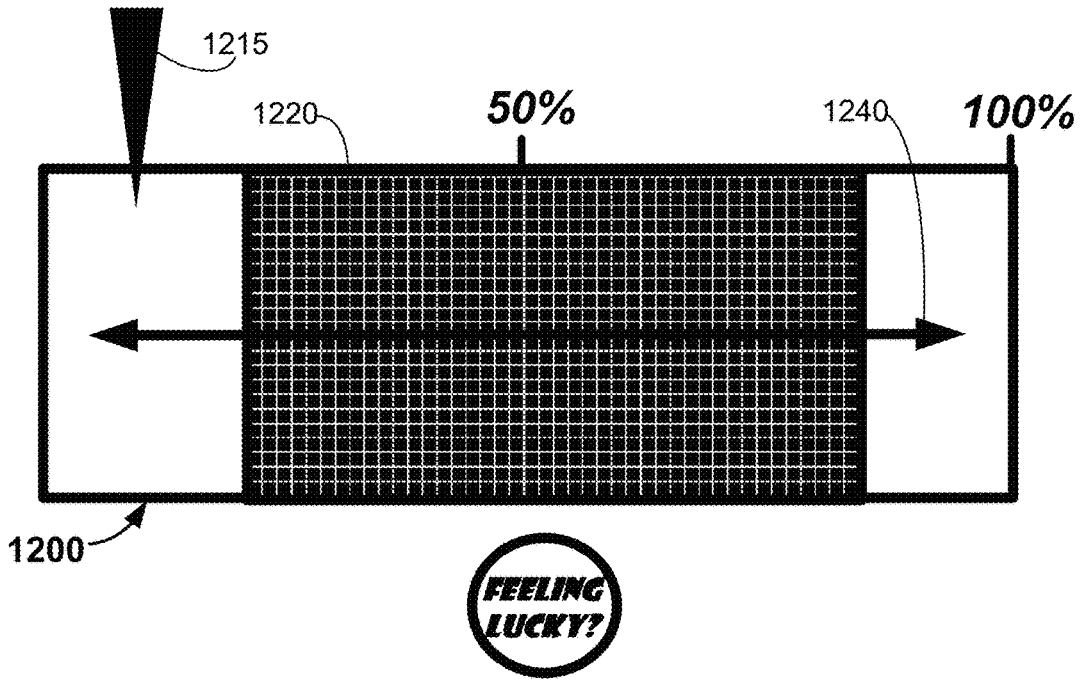

According to the example shown in FIG. 13D, presenting the "third visual effects" involves causing a representation of the bar 1220 to slide back and forth along a line represented by the arrow 1240, which in this example is parallel to the long axis of the feature award credit meter 1200. If it is determined that an award of the feature will be triggered, in this example the bar 1220 will stop in a position such that the pointer 1215 is at a position within the bar 1220. In this example, if it is determined that an award of the feature will not be triggered, the bar 1220 will stop in a position such that pointer 1215 is somewhere outside of the bar 1220.

Because the feature award credit meter 1200 may change or metamorphose over time in response to events that occur during individual instances of a game, the feature award credit meter 1200 may be considered to be an example of what is sometimes referred to as a "metamorphic," a "game metamorphic," a "metamorphic image," a "metamorphic meter," etc.

As described herein, the feature award credit meter 1200 may metamorphose over time in response to events that occur during individual instances of games that are being played by more than one player. In some such examples, the feature award credit meter 1200 may metamorphose in response to events that occur during individual instances of games that are being played on multiple gaming devices within the same casino, e.g., instances of games that are being played on multiple gaming devices within the same bank of casinos. However, in alternative implementations the feature award credit meter 1200 may metamorphose in response to events that occur during individual instances of games that are being played on multiple networked gaming devices that may or may not be EGMs, depending on the particular implementation. In some examples, the gaming devices may include mobile devices such as those described above with reference to FIG. 3 and/or EUDs as described above with reference to FIG. 4.

The events may correspond to instances of game play items that correspond to feature award credits towards an automatic award of a feature comprising one or more bonus games. The game play items may include symbols, combinations of symbols, or both symbols and combinations of symbols, e.g., as disclosed herein.

According to some examples, each of the networked gaming devices may be configured to display an instance of the feature award credit meter 1200. In some such implementations, the feature award credit meter 1200 presented on each of the networked gaming devices may be updated according to symbols, corresponding to feature award credits, that land during instances of games being played by each gaming device in a group of networked and participating gaming devices. The displayed feature award credit meter 1200 may or may not be similar to those shown in FIGS. 12A-13D, depending on the particular implementation. Some implementations may involve displaying multiple feature award credit meters on the participating gaming devices. For example, each of the feature award credit meters may correspond to an individual progressive or jackpot. In some examples, the feature award credit meter(s) may be similar to those disclosed herein: for example, the feature award credit meter(s) may be, or may include, strings of firecrackers that grow and/or change color as the feature award credit meter(s) metamorphose. According to some examples, the feature award credit meter 1200 presented on some of the participating gaming devices may differ from the feature award credit meter 1200 presented on other participating gaming devices.

In some implementations, any player using a participating gaming device whose game instance causes the accumulated number of feature award credits to equal or exceed the number of feature award credits necessary for an automatic award of the feature will be awarded the feature. In some examples, any player using a participating gaming device may decide to attempt to trigger a feature at a time during which less than a number of feature award credits necessary for an automatic award of the feature has been accumulated. According to some implementations, any player using a participating gaming device may decide to attempt to trigger the feature using any of the methods disclosed herein, including but not limited to methods that involve purchasing the remaining number of feature award credits necessary for an automatic award of the feature.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

The invention claimed is:

1. An electronic gaming device, comprising:

a display system including one or more displays;

an interface system including at least one network interface and at least one user interface; and a control system including one or more processors, the control system being configured for:

controlling the display system to present first visual effects corresponding to one or more instances of a game, the first visual effects including game events;

controlling the display system to present second visual effects corresponding to a metamorphic image, the metamorphic image corresponding to an award, the award comprising a feature award of one or more bonus games, the metamorphic image corresponding to an accumulation of feature award credits towards an automatic feature award, the first visual effects including game play items that correspond to the feature award credits, wherein presenting the second visual effects involves indicating changes in the metamorphic image in response to game event data corresponding to one or more games presented on the electronic gaming device, wherein presenting the second visual effects further involves indicating changes in the metamorphic image in response to networked gaming device game event data received via the interface system, the networked gaming device game event data corresponding to one or more games presented on one or more other electronic gaming devices;

receiving an indication, via the interface system, of a player's initiation of an attempt to trigger a grant of the feature award, wherein the indication is received at a time during which less than a number of feature award credits necessary for an automatic grant of the feature award has been accumulated;

determining whether the feature award will be granted; and controlling the display system to present third visual effects corresponding to whether the feature award has been granted.

2. The electronic gaming device of claim 1, wherein the metamorphic image corresponds to a number of game events that have occurred since the award has been granted, the game events comprising local gaming device game events and networked gaming device game events.

3. The electronic gaming device of claim 1, wherein the metamorphic image corresponds to a probability of the award being granted.

4. The electronic gaming device of claim 1, wherein the award comprises a credit award.

5. The electronic gaming device of claim 4, wherein the credit award comprises a progressive jackpot award.

6. The electronic gaming device of claim 1, wherein, upon determining that a feature award will be granted, the control system is further configured for controlling the display system to present fourth visual effects corresponding to the feature award.

7. A method of controlling an electronic gaming device, the method comprising:

controlling, via a control system of the electronic gaming device, a display system of the electronic gaming device to present first visual effects corresponding to one or more instances of a game, the first visual effects including game events;

controlling, via the control system, the display system to present second visual effects corresponding to a metamorphic image, the metamorphic image corresponding to an award, the award comprising a feature award of one or more bonus games, the metamorphic image corresponding to an accumulation of feature award credits towards an automatic feature award, the first visual effects including game play items that correspond to the feature award credits, wherein presenting the second visual effects involves indicating changes in the metamorphic image in response to game event data corresponding to one or more games presented on the electronic gaming device, wherein presenting the second visual effects further involves indicating changes in the metamorphic image in response to networked gaming device game event data received via an interface system of the electronic gaming device, the networked gaming device game event data corresponding to one or more games presented on one or more other electronic gaming devices;

receiving an indication, via the interface system, of a player's initiation of an attempt to trigger a grant of the feature award, wherein the indication is received at a time during which less than a number of feature award credits necessary for an automatic grant of the feature award has been accumulated;

determining, via the control system, whether the feature award will be granted; and controlling, via the control system, the display system to present third visual effects corresponding to whether the feature award has been granted.

8. The method of claim 7, wherein the metamorphic image corresponds to a number of game events that have occurred since the award has been granted, the game events comprising local gaming device game events and networked gaming device game events.

9. The method of claim 7, wherein the metamorphic image corresponds to a probability of the award being granted.

10. The method of claim 7, wherein the metamorphic image does not correspond to a probability of the award being granted.

11. The method of claim 7, wherein the award comprises a credit award.

12. The method of claim 7, wherein the credit award comprises a progressive jackpot award.

13. An electronic gaming device, comprising:

a display system including one or more displays;

an interface system including at least one network interface and at least one user interface; and a control system including one or more processors, the control system being configured for:

controlling the display system to present first visual effects corresponding to one or more instances of a game, the first visual effects including game events;

controlling the display system to present second visual effects corresponding to a metamorphic image, the metamorphic image corresponding to an award, the metamorphic image comprising a string of firecrackers, wherein presenting the second visual effects involves indicating changes in the metamorphic image in response to game event data corresponding to one or more games presented on the electronic gaming device, wherein presenting the second visual effects further involves indicating changes in the metamorphic image in response to networked gaming device game event data received via the interface system, the networked gaming device game event data corresponding to one or more games presented on one or more other electronic gaming devices;

determining whether the award will be granted; and controlling the display system to present third visual effects corresponding to whether the award will be granted.

14. The electronic gaming device of claim 13, wherein the metamorphic image corresponds to a number of game events that have occurred since the award has been granted, the game events comprising local gaming device game events and networked gaming device game events.

15. The electronic gaming device of claim 13, wherein the metamorphic image corresponds to a probability of the award being granted.

16. The electronic gaming device of claim 13, wherein the award comprises a credit award.

17. The electronic gaming device of claim 16, wherein the credit award comprises a progressive jackpot award.

18. The electronic gaming device of claim 13, wherein:

the award comprises a feature award, the feature award comprising an award of one or more bonus games, the metamorphic image corresponds to an accumulation of feature award credits towards an automatic feature award, and the first visual effects include game play items that correspond to the feature award credits.

19. The electronic gaming device of claim 18, wherein the control system is further configured for:

receiving an indication, via the interface system, of a player's initiation of an attempt to trigger a grant of the feature award, wherein the indication is received at a time during which less than a number of feature award credits necessary for an automatic grant of the feature award has been accumulated;

determining whether a feature award will be granted; and controlling the display system to present fourth visual effects corresponding to whether a feature award has been granted.

20. The electronic gaming device of claim 19, wherein, upon determining that a feature award will be granted, the control system is further configured for controlling the display system to present fifth visual effects corresponding to a feature award.

* * * * *